US007587776B2

(12) United States Patent
Poulos

(10) Patent No.: US 7,587,776 B2
(45) Date of Patent: Sep. 15, 2009

(54) DYNAMIC THERAPY BED SYSTEM

(75) Inventor: Craig Poulos, Wilmette, IL (US)

(73) Assignee: Kreg Medical, Inc., Chicago, IL (US)

( * ) Notice: Subject to any disclaimer, the term of this patent is extended or adjusted under 35 U.S.C. 154(b) by 322 days.

(21) Appl. No.: 11/502,633

(22) Filed: Aug. 10, 2006

(65) Prior Publication Data

US 2007/0070684 A1 Mar. 29, 2007

Related U.S. Application Data

(63) Continuation-in-part of application No. 11/349,683, filed on Feb. 8, 2006.

(60) Provisional application No. 60/707,074, filed on Aug. 10, 2005.

(51) Int. Cl.
*A47C 27/10* (2006.01)
*A61G 7/057* (2006.01)

(52) U.S. Cl. ..... 5/713

(58) Field of Classification Search ..... 5/713, 5/710, 654, 655.3

See application file for complete search history.

(56) References Cited

U.S. PATENT DOCUMENTS 1,772,310 A * 8/1930 Hart ..... 5/713
4,686,725 A 8/1987 Mitchell
4,706,313 A 11/1987 Murphy
4,852,195 A * 8/1989 Schulman ..... 5/713
4,864,671 A * 9/1989 Evans ..... 5/713
4,901,387 A 2/1990 Luke
4,949,414 A 8/1990 Thomas et al.
4,977,629 A 12/1990 Jones
5,025,519 A 6/1991 Spann et al.
5,031,261 A 7/1991 Fenner, Sr.
5,039,158 A 8/1991 Maier
5,070,560 A 12/1991 Wilkinson
5,117,521 A 6/1992 Foster et al.
5,121,513 A 6/1992 Thomas et al.
5,163,196 A 11/1992 Graebe et al.

(Continued)

*Primary Examiner*—Alexander Grosz
(74) *Attorney, Agent, or Firm*—McDermott Will & Emery LLP

(57) ABSTRACT

A therapeutic mattress system is provided for treating a patient. The mattress system has a mattress having plurality of vertically elongated cells extending from a base layer that are arranged in a row and column grid arrangement. Each cell has a sidewall and a patient support surface extending therefrom, and a cavity defined interior of the sidewall, the patient support surface and the base layer. The elongated cells are further grouped into a first group of cells and a second group of cells such that the cavities of the cells of the first group are fluidly interconnected to define a first group chamber and the cavities of the cells of the second group are fluidly interconnected to define a second group chamber. Further, the chamber of the first group is not fluidly interconnected with the chamber of the second group. Additionally, the cells of the first group alternate with the cells of the second group diagonally across the mattress. Each of the grouping of cells has an inlet port and an exit port. Air can be injected into the respective group of cells at the inlet port and at least a portion of the air in each group of cells can be exhausted from the respective exit ports. A blower assembly is also provided to provide and exhaust air from the respective air chambers in one of a standard, alternating pressure, rotation, wound therapy, percussion or vibration mode.

19 Claims, 21 Drawing Sheets

U.S. PATENT DOCUMENTS 5,179,742 A 1/1993 Oberle
5,182,826 A 2/1993 Thomas et al.
5,252,278 A 10/1993 Spann et al.
5,267,365 A 12/1993 Walter
5,325,551 A 7/1994 Tappel et al.
5,335,651 A 8/1994 Foster et al.
5,337,845 A 8/1994 Foster et al.
5,370,111 A 12/1994 Reeder et al.
D355,322 S 2/1995 Ackley et al.
5,412,821 A 5/1995 Wilkinson
5,425,148 A 6/1995 Ashcraft et al.
5,454,142 A 10/1995 Neely et al.
5,457,831 A 10/1995 Foster et al.
5,461,741 A 10/1995 Graebe
5,479,666 A 1/1996 Foster et al.
5,483,709 A 1/1996 Foster et al.
5,497,766 A 3/1996 Foster et al.
5,513,406 A 5/1996 Foster et al.
5,562,091 A 10/1996 Foster et al.
5,577,279 A 11/1996 Foster et al.
5,580,504 A 12/1996 Spann et al.
5,586,346 A 12/1996 Stacy et al.
5,596,781 A 1/1997 Graebe
5,606,754 A 3/1997 Hand et al.
5,611,096 A 3/1997 Bartlett et al.
5,613,255 A 3/1997 Bish et al.
5,630,238 A 5/1997 Weismiller et al.
5,649,331 A 7/1997 Wilkinson et al.
5,652,985 A 8/1997 Wilkinson et al.
5,666,681 A 9/1997 Meyer et al.
5,672,849 A 9/1997 Foster et al.
5,680,661 A 10/1997 Foster et al.
5,689,845 A 11/1997 Sobieralski
5,708,997 A 1/1998 Foster et al.
5,715,548 A 2/1998 Weismiller et al.
5,731,062 A 3/1998 Kim et al.
5,745,937 A 5/1998 Weismiller et al.
5,781,949 A 7/1998 Weismiller et al.
5,845,352 A 12/1998 Matsler et al.
5,933,888 A 8/1999 Foster et al.
5,983,429 A 11/1999 Stacy et al.
5,987,668 A 11/1999 Ackley
6,036,271 A 3/2000 Wilkinson et al.
6,047,424 A 4/2000 Osborne et al.
6,098,222 A 8/2000 Hand et al.
6,112,345 A 9/2000 Foster et al.
6,119,291 A 9/2000 Osborne et al.
6,151,739 A 11/2000 Meyer et al.
6,163,903 A 12/2000 Weismiller et al.
6,212,714 B1 4/2001 Allen et al.
6,223,369 B1 5/2001 Maier et al.
6,269,504 B1 8/2001 Romano et al.
6,286,166 B1 9/2001 Henley et al.
6,295,675 B1 10/2001 Ellis et al.
6,324,709 B1 12/2001 Ikeda et al.
6,351,863 B1 3/2002 Meyer et al.
6,353,950 B1 3/2002 Bartlett et al.
6,374,436 B1 4/2002 Foster et al.
6,415,814 B1 7/2002 Hand et al.
6,446,283 B1 9/2002 Heimbrock et al.
6,496,993 B2 12/2002 Allen et al.
6,499,167 B1 12/2002 Ellis et al.
6,536,056 B1 3/2003 Vrzalik et al.
6,560,793 B2 5/2003 Walker
6,584,628 B1 7/2003 Kummer et al.
6,611,979 B2 9/2003 Welling et al.
6,623,080 B2 9/2003 Clapper
6,640,361 B2 11/2003 Heimbrock et al.
6,684,427 B2 2/2004 Allen et al.
6,687,936 B2 2/2004 Graebe et al.
6,694,548 B2 2/2004 Foster et al.
6,701,556 B2 3/2004 Romano et al.
6,725,474 B2 4/2004 Foster et al.
6,751,815 B2 6/2004 Heimbrock et al.
6,782,574 B2 8/2004 Totton et al.
6,820,640 B2 11/2004 Hand et al.
6,874,185 B1 4/2005 Phillips et al.
6,880,189 B2 4/2005 Welling et al.
6,892,405 B1 5/2005 Dimitriu et al.
6,901,617 B2 6/2005 Sprouse, II et al.
6,904,631 B2 6/2005 Vrzalik et al.
6,922,863 B2 8/2005 Giori et al.
6,928,681 B1 8/2005 Stacy
6,952,852 B2 10/2005 Reeder et al.
6,976,281 B2 12/2005 Schunk et al.
7,346,945 B2 3/2008 Phillips et al.
2002/0059679 A1 5/2002 Weismiller et al.
2003/0079293 A1 5/2003 Ellis et al.
2003/0208847 A1 11/2003 Vrzalik et al.
2003/0221391 A1 12/2003 Bolton
2004/0034931 A1 2/2004 Kummer et al.
2005/0012377 A1 1/2005 Ito
2005/0028289 A1 2/2005 Hakamiun
2005/0034764 A1 2/2005 Hanh et al.
2005/0229321 A1 10/2005 Phillips et al.
2006/0101581 A1 5/2006 Blanchard et al.
2006/0272097 A1 12/2006 Dionne et al.
2007/0070684 A1 3/2007 Poulos

* cited by examiner

DYNAMIC THERAPY BED SYSTEM

CROSS-REFERENCE TO RELATED APPLICATIONS

This application is a continuation-in-part of U.S. patent application Ser. No. 11/349,683, filed on Feb. 8, 2006, which is a continuation-in-part of U.S. Provisional Patent Application Ser. No. 60/707,074, filed on Aug. 10, 2005, both of which applications are expressly incorporated herein by reference and made a part hereof.

FEDERALLY SPONSORED RESEARCH OR DEVELOPMENT

Not Applicable.

TECHNICAL FIELD

The invention relates to a dynamic therapy bed and mattress system having several modes of operation for patient treatment, including standard, percussion, vibration, rotation, alternating pressure, wound therapy and various combinations thereof.

BACKGROUND OF THE INVENTION

Therapeutic alternating pressure, percussion and/or vibrating bed systems are used in the care and treatment of individuals, including hospital patients confined to a bed for an extended period of time. Conventional therapeutic bed systems utilize percussion and/or vibration to help avoid the build-up and accumulation of fluid within the patient's lungs. Percussion and vibration is typically administered to the patient's thoracic cavity to aid with the draining or expectorant of fluid and mucus from the patient's lungs. Conventional bed systems may also employ rotation and/or alternating pressure to help the patient avoid the onset of bed sores and/or to treat existing sores. Conventional bed systems can include rotational components that are actuated by a nurse or hospital staff member, or by an electronic control system or pump. The present invention is designed to solve problems inherent to the conventional dynamic therapy bed and mattress systems, and to provide advantages and aspects not provided by prior bed systems of this type. A full discussion of the features and advantages of the present invention is deferred to the following detailed description, which proceeds with reference to the accompanying drawings.

SUMMARY OF THE INVENTION

The present invention generally provides a therapeutic mattress and a therapeutic mattress system. According to one embodiment the therapeutic mattress comprises an inflatable mattress having a plurality of elongated cells, wherein the cells are grouped together in a specific air chamber configuration to allow for unique therapy resulting on a patient positioned on the therapeutic mattress.

According to another embodiment, the mattress has a plurality of vertically elongated cells extending from a base layer, the vertically elongated cells being arranged in a row and column grid arrangement. Each cell has a sidewall and a patient support surface extending therefrom, and a cavity defined interior of the sidewall and the patient support surface. The elongated cells are grouped into a first group of cells and a second group of cells, wherein the cavities of the cells of the first group are fluidly interconnected to define a first group chamber, wherein the cavities of the cells of the second group are fluidly interconnected to define a second group chamber, and wherein the first group chamber is not fluidly interconnected with the second group chamber.

According to another embodiment, the cells of the first group alternate with the cells of the second group diagonally across the mattress.

According to another embodiment, the vertically elongated cells have movement about six degrees of freedom, including both directions in an x-axis, both directions in a y-axis and both directions in the z-axis.

According to another embodiment, the first group of cells have an inlet port and an exit port to allow air to be injected into the first group of cells at the inlet port and to allow at least a portion of the air in the first group of cells to be exhausted from the exit port. The second group of cells also have an inlet port and an exit port to allow air to be injected into the second group of cells at the inlet port and to allow at least a portion of the air in the second group of cells to be exhausted from the exit port.

According to another embodiment, the therapeutic mattress system includes a pump or blower to supply air to the mattress as required. In one embodiment the pump/blower has a first port in fluid communication with the inlet port of the first group of cells, a second port in fluid communication with the exit port of the first group of cells, a third port in fluid communication with the inlet port of the second group of cells, and a fourth port in fluid communication with the exit port of the second group of cells.

According to another embodiment, the therapeutic mattress system provides treatment to a patient through several modes of operation, including standard, alternating pressure, percussion, vibration, rotation, wound therapy and various combinations thereof.

According to yet another embodiment, the pump/blower supplies air to each inlet port in an alternating manner to have one of the first group of cells and the second group of cells at a first pressure and the other of the first group of cells and the second group of cells at a second pressure. In one embodiment the second pressure is lower than the first pressure at a first period of time, and the second pressure is greater than the first pressure at a second period of time.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
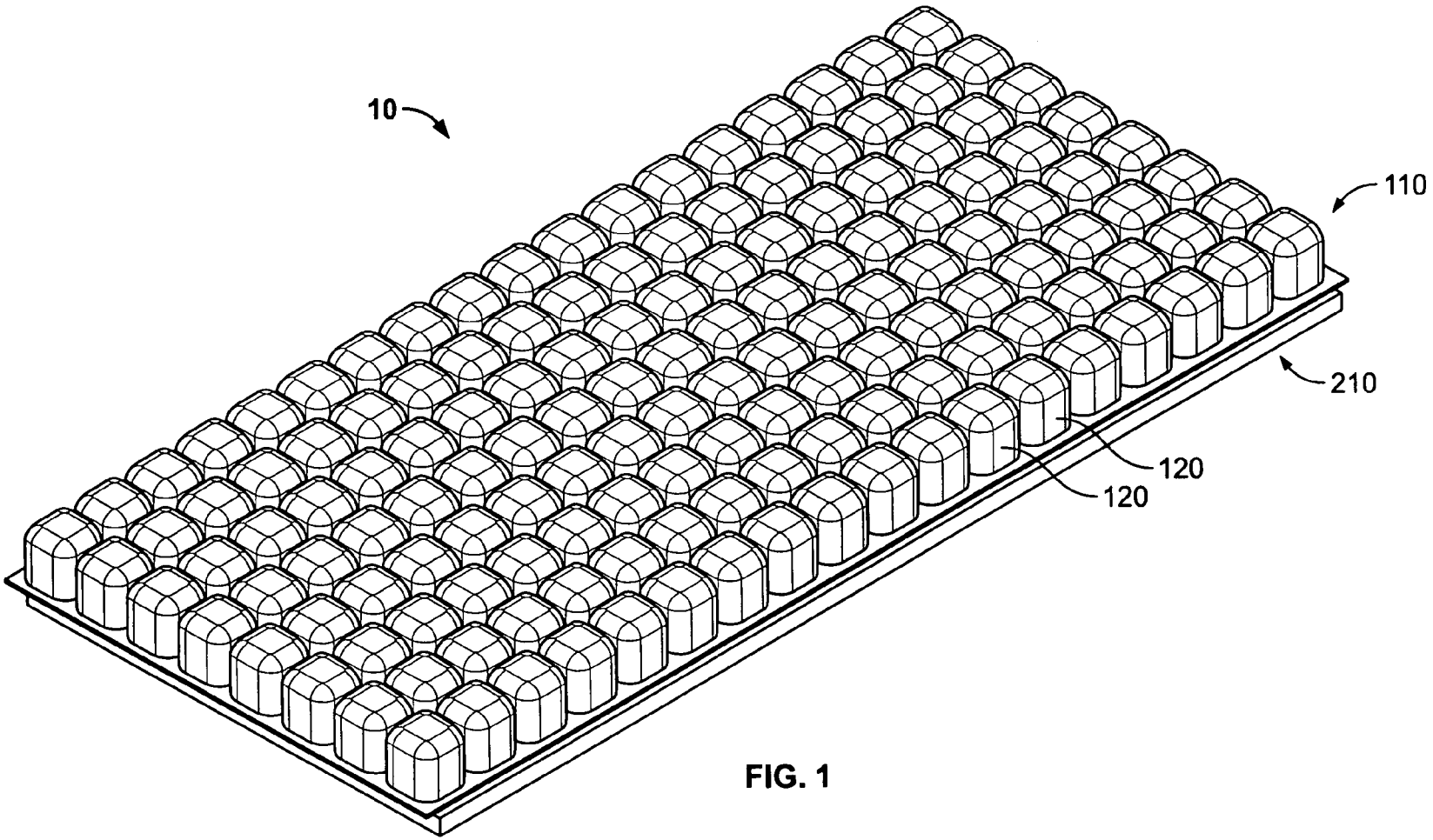
FIG. 1 is a perspective view of one embodiment of a therapeutic bed system.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A dynamic therapy bed system 10 is shown in the figures. Although the bed frame or support structure is not shown, it is understood that the system 10 is intended for use with a variety of conventional bed frames including those found in hospitals and health care facilities. In one embodiment, the bed system 10 includes a patient support layer 110, a plenum layer 210, a blower assembly 310, and an activation valve assembly 410. As explained in greater detail below, the bed system 10 provides treatment to a patient through several modes of operation, including standard, alternating pressure, percussion, vibration, rotation, wound therapy and various combinations thereof.

Figure 2:
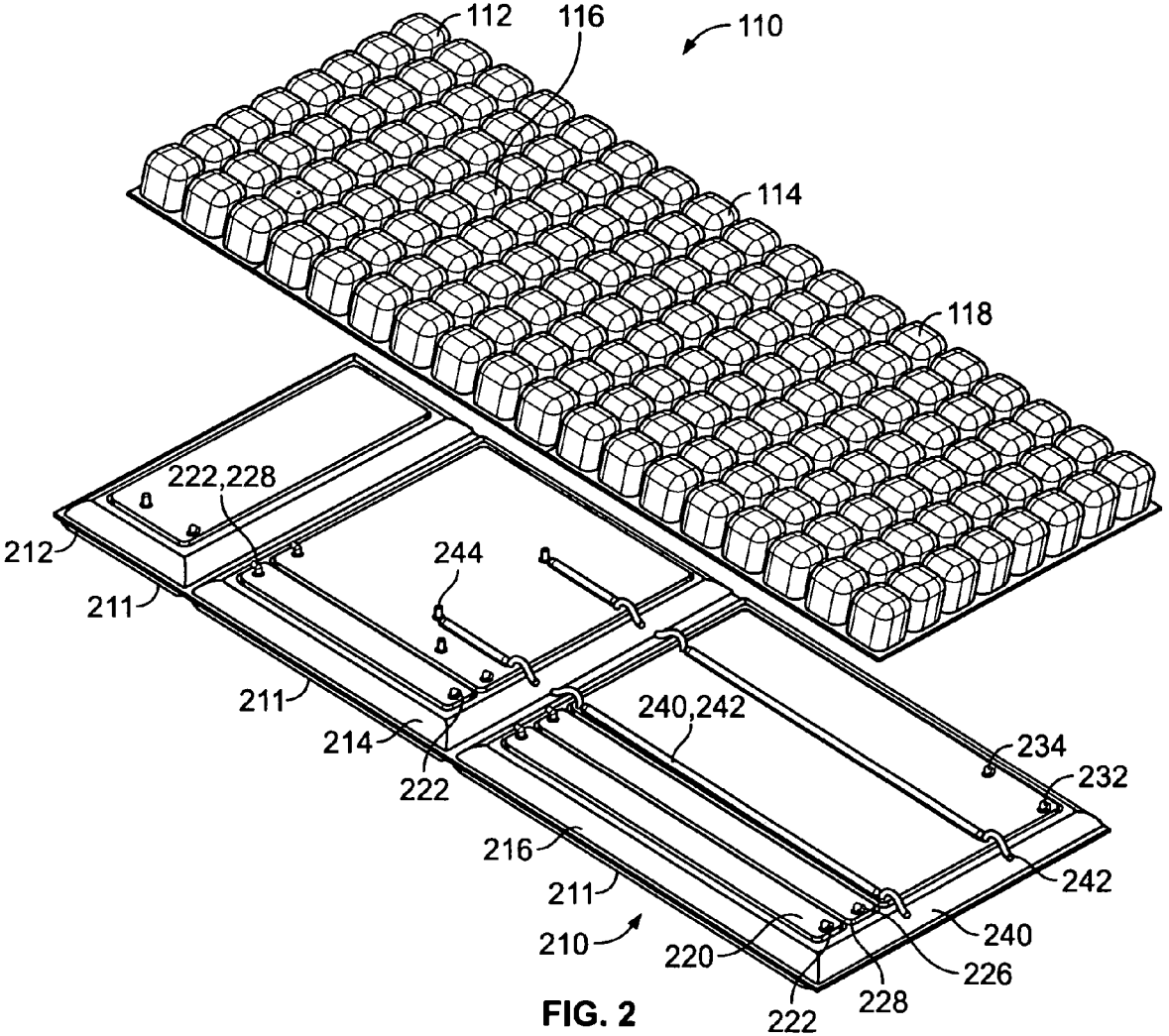
FIG. 2 is a perspective view of the bed system of FIG. 1, showing a patient support layer exploded from a plenum layer.

Referring to FIGS. 1-2, the patient support layer 110 is the uppermost layer of one embodiment of the bed system 10 or mattress and includes a head section 112, a torso section 114, an activation section 116, and a lower body section 118. As explained below, in one embodiment the activation section 116 is positioned within the torso section 114 and is configured to apply alternating pressure, percussion and/or vibration forces to treat the patient. Alternatively, the entire patient support layer 110 may be an activation section 116, such as with an full alternating pressure mattress. In another configuration of the bed system 10, the torso section 114 and head section 112 are combined as an integrated unit that receives the activation section 116. The head, torso, activation and lower body sections 112-118 each have an array of cells 120 that are in fluid communication with other cells 120 in each respective section 112-118. The cells 120 of the sections 112-118 collectively define a patient support surface. The cells 120 may be comprised of closed cell configurations (i.e., wherein air pressure is generally maintained at a constant pressure in the mattress) or open-cell configurations (i.e., wherein a blower or other provider of air is connected to the mattress such that air pressure in the chamber of the mattress can be varied real time). Alternatively, any section of the patient support layer 110, other than the activation section 116, may be made of a non-inflatable component, such as foam, with an activation section 116 provided in the non-inflatable component as necessary.

Figure 3:
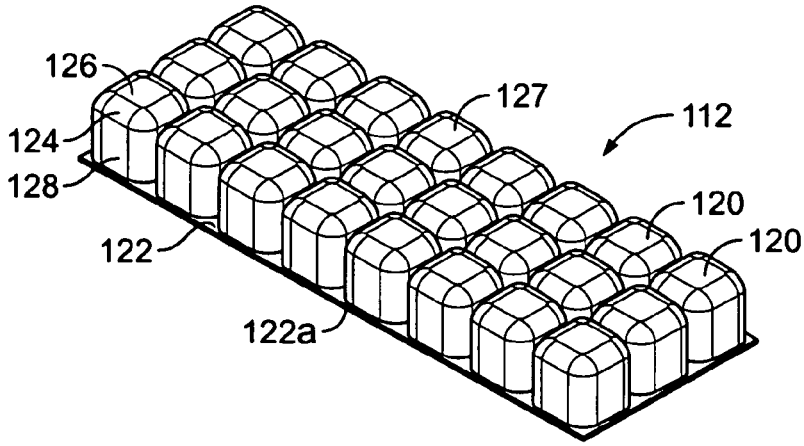
FIG. 3 is a perspective view of a head section of the patient support layer.
Figure 4:
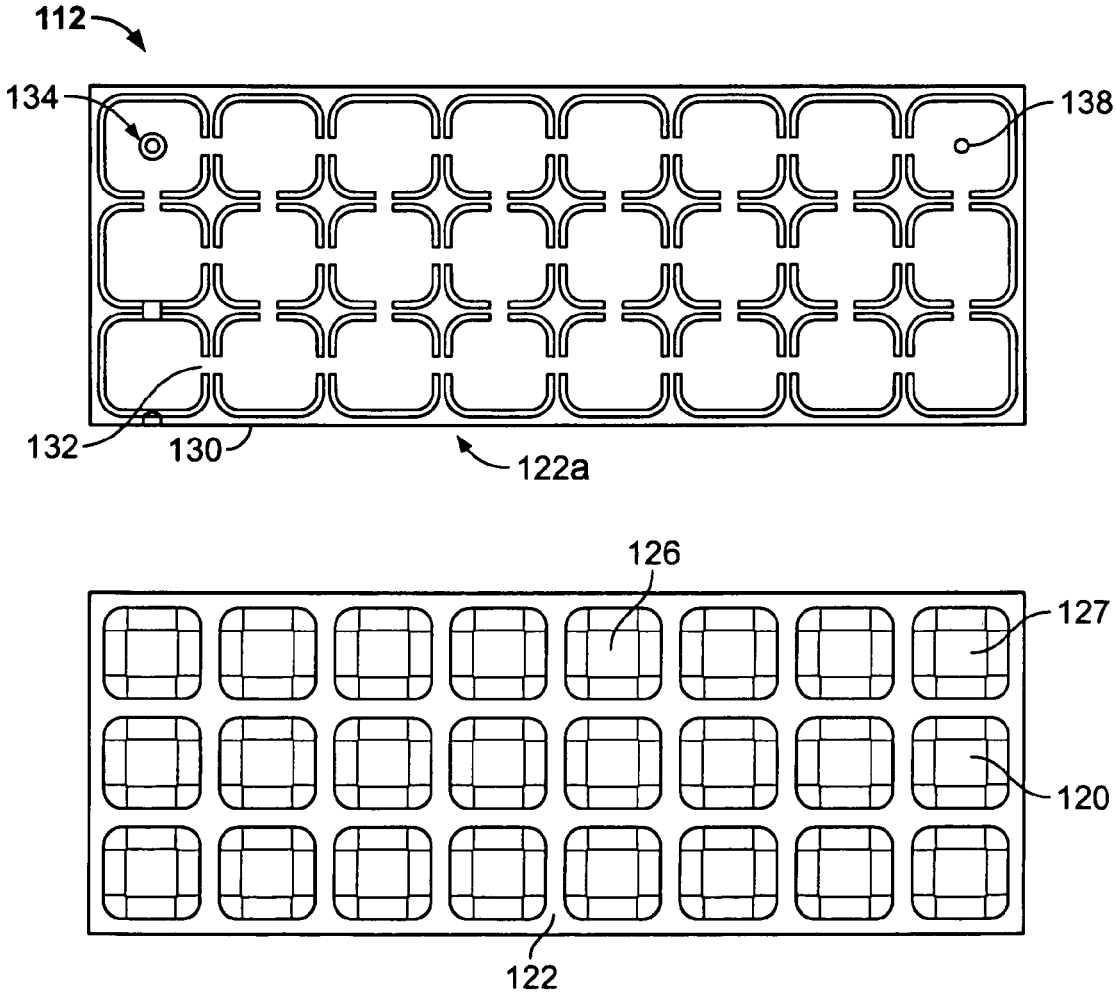
FIG. 4 is a bottom view and a top view of the head section of the patient support layer.
Figure 5:
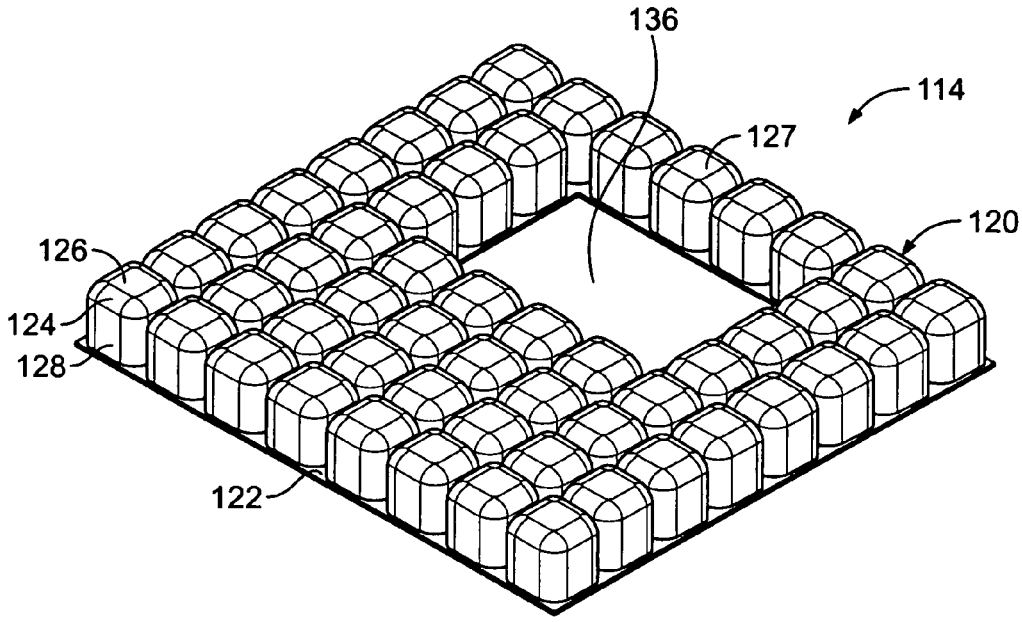
FIG. 5 is a perspective view of a torso section of the patient support layer.
Figure 19:
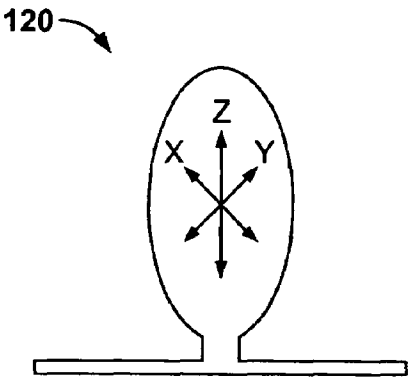
FIG. 19 is a schematic view of a cell of the alternating pressure mattress of FIG. 18.

As shown in FIGS. 3 and 4, the head section 112 has an array of cells 120 extending from a base 122. Each cell 120 has an upper portion 124 with a top wall 126, and a lower portion 128. The top walls 126 collectively define a head patient support surface 127 of the head section 112. The top wall 126 may by flat or have an alternate configuration such as a peaked star or otherwise as shown herein. The lower portion 128 of each cell 120 includes a side wall arrangement 130, wherein each interior side wall 130 includes an opening 132. As shown in FIG. 5, in one embodiment the openings 132 are aligned to provide fluid communication between the cells 120, allowing the blower assembly 310 or other provider of air to supply air simultaneously to all cells 120 that are in fluid communication within the section. In one embodiment the exterior side walls 130 lack an opening 132 since there is no cell 120 beyond the periphery 122*a* of the base 122. In one embodiment, the cells 120 have an overall height of between 2.5" and 10", and preferably approximately four inches, however, the overall height varies with the design parameters of the bed system 10. Accordingly, the cells 120 are generally elongated vertically as opposed to typical cells on certain alternating pressure pads. In one embodiment, the cells 120 are independent in structure in that they can attain movement in at least six degrees of freedom as shown in FIG. 19, including movement in both directions in an x-axis, both directions in a y-axis and both directions in the z-axis. By having a mattress that can move air from one cell 120 to adjoining cells 120 as necessary, and by having air cells 120 that are able to move in multiple directions assists in being able to immerse the patient in the mattress 10 to reduce the overall pressure on the surface of the contact areas of the patient.

The head section 112 includes an air supply fitting 134 and an exhaust or relief fitting 138. As explained herein, with any section of the patient support layer 110 the inlet port 134 may also be utilized as an exit port such that only one port per chamber is necessary. The blower assembly 310 supplies air via the plenum layer 210 or directly to the cells 120 in the head section 112 to support the patient's head when it rests on the patient support surface 127. The fitting 134 depends from a lower surface of the base 122. In one embodiment, the head section 112 has a three by eight array of cells 120 providing a rectangular configuration to the section 112, however, the precise number of cells 120 in the array can vary as well as the resulting configuration of the head section 112. The cells 120 and the base 122 are formed from urethane, neoprene, or any other material having similar strength and durability traits, wherein the material thickness is preferably greater than 10 mils.

Referring to FIG. 5, in one embodiment the torso section 114 has an array of cells 120 that are typically similar to those found in the head section 112. The top walls 126 of the cells 120 collectively define a torso patient support surface 127. In an embodiment with an activation section 116, the torso section 114 also has an aperture 136 configured to receive the activation section 116. Like the head section 112, the torso section 114 includes an air supply fitting 134 and an exhaust or relief fitting 138. The blower assembly 310 supplies air either directly to the cells 120 or via the plenum layer 210 to the cells 120 in the torso section 114 to support the patient's torso when it rests on the support surface 127. In one embodiment, the torso section 114 has a seven by eight array of cells 120 providing a rectangular configuration to the section 114, wherein a number of cells 120 are omitted to define the aperture 136. The aperture 136 is cooperatively dimensioned to receive activation section 116, so the precise configuration of the aperture 136 varies with the design parameters of the bed system 10. As mentioned above, the head and torso sections 112, 114 can be combined into a single unit of the patient support layer 110.

Figure 6:
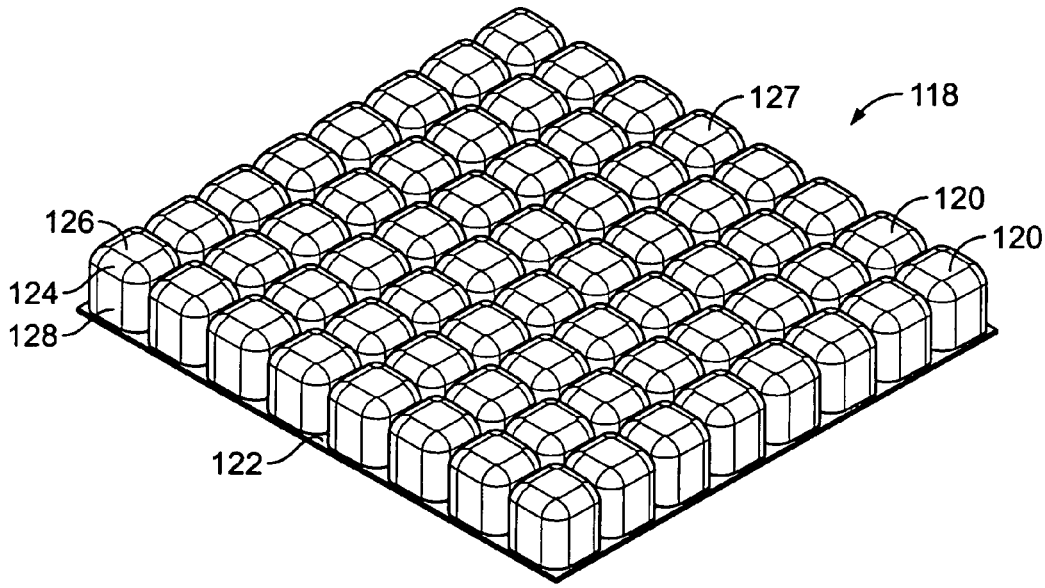
FIG. 6 is a perspective view of a lower body section of the patient support layer.

As shown in FIG. 6, the lower body section 118 also has an array of cells 120 that are similar to those found in the head and torso sections 112, 114. The top walls 126 of the cells 120 collectively define a lower patient support surface 127 of the section 118. Like the head section 112, the leg section 118 includes an air supply fitting 134 and an exhaust or relief fitting 138. The blower assembly 310 supplies air via the plenum layer 210 or directly to the cells 120 in the lower body section 118 to support the patient's lower body region when it rests on the support surface 127. In one embodiment, the lower body section 118 has an eight by eight array of cells 120 providing a square configuration to the section 118, however, the configuration can be varied depending upon design parameters including the size of the cells 120.

Figure 7:
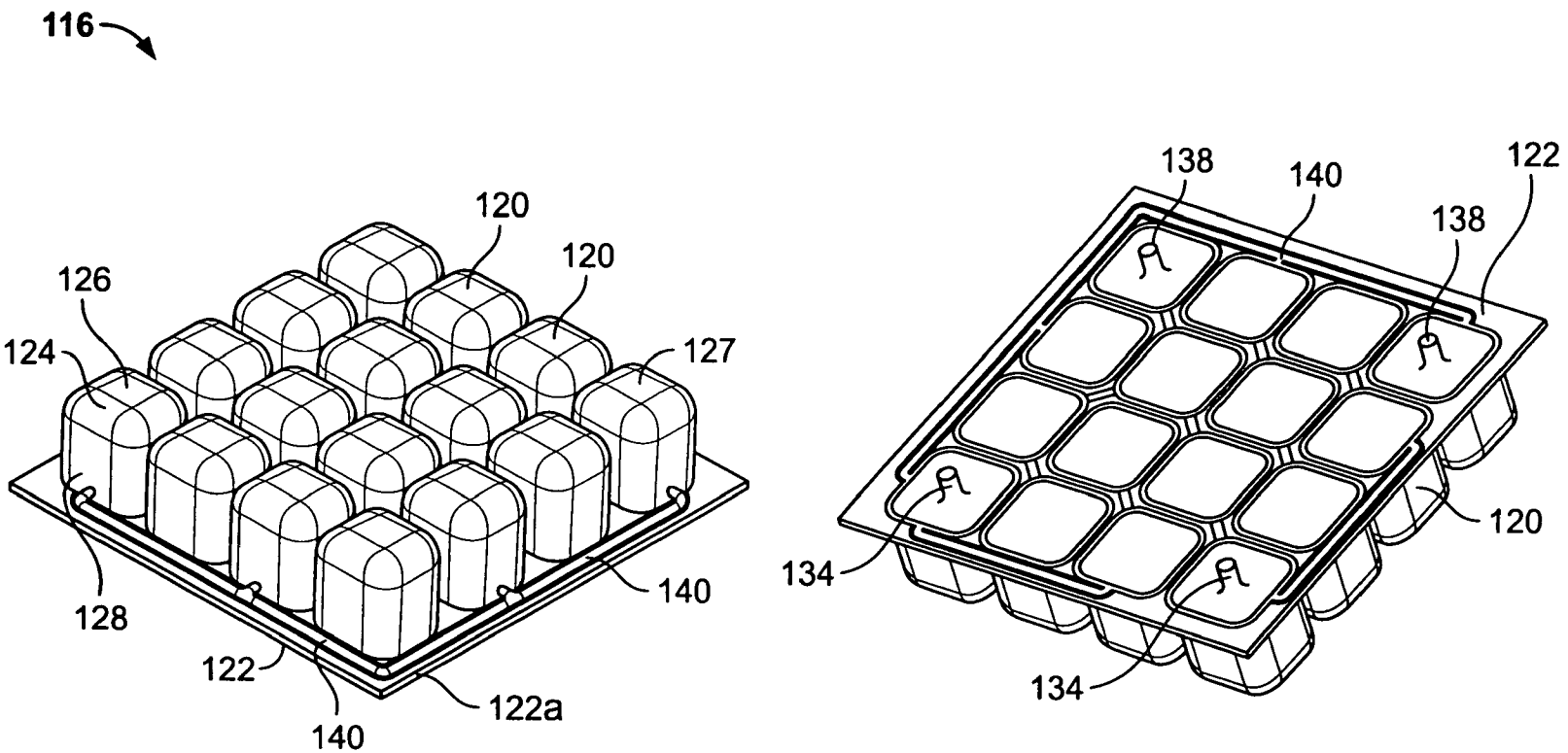
FIG. 7 is a top and bottom perspective view of an activation section of the patient support layer.
Figure 7A:
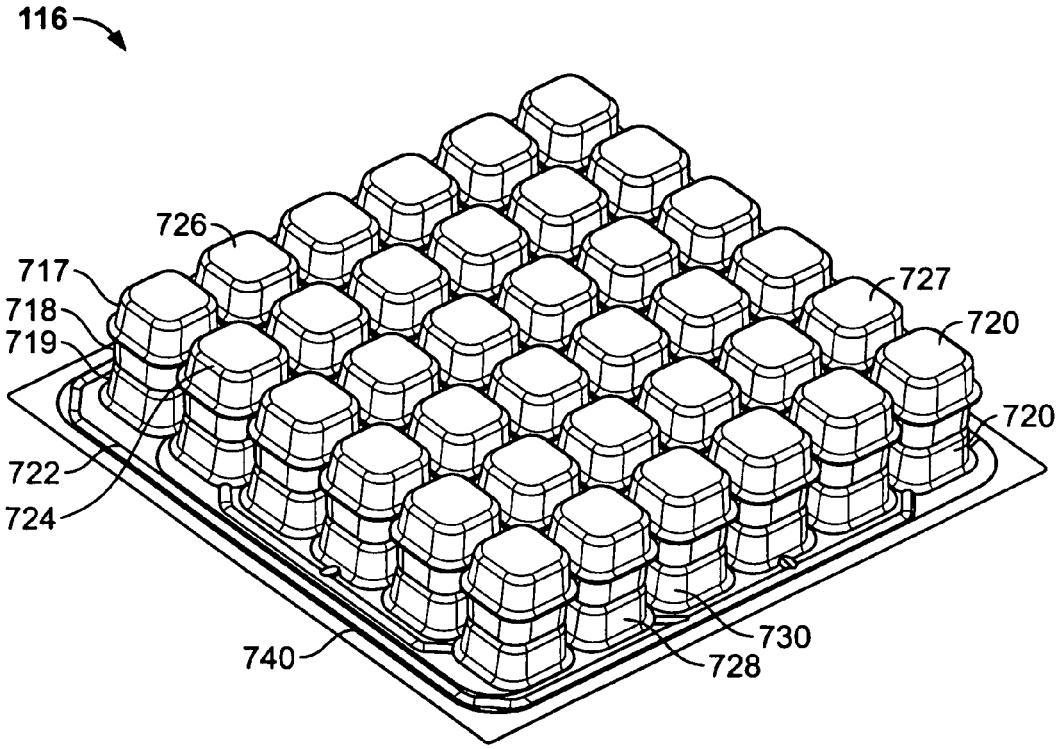
FIG. 7A is a perspective view of an alternate embodiment of an array of cells for the patient support layer as provided in an activation section.
Figure 8:
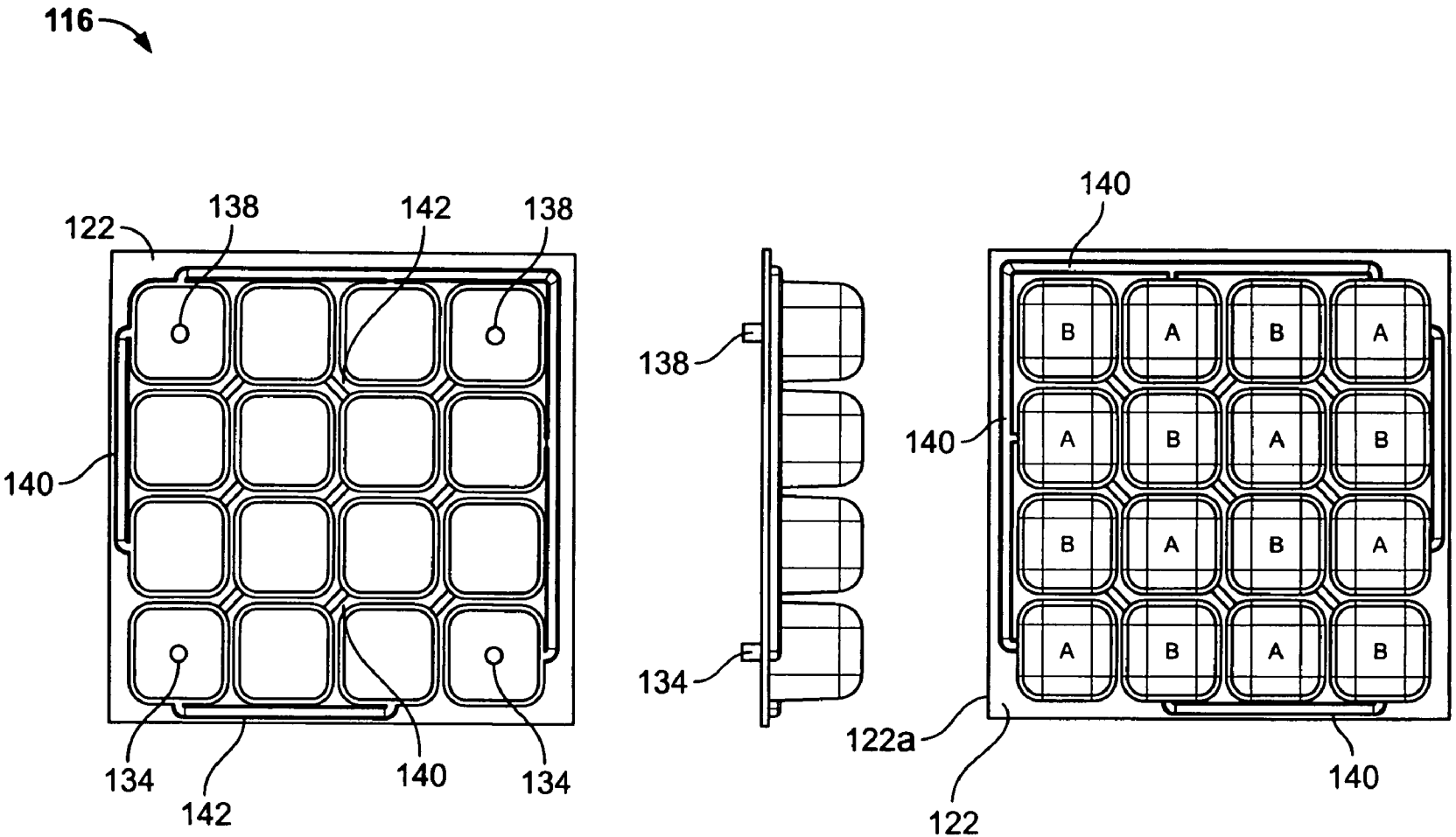
FIG. 8 is a bottom view, a side view and a top view of the activation section of the patient support layer.
Figure 18:
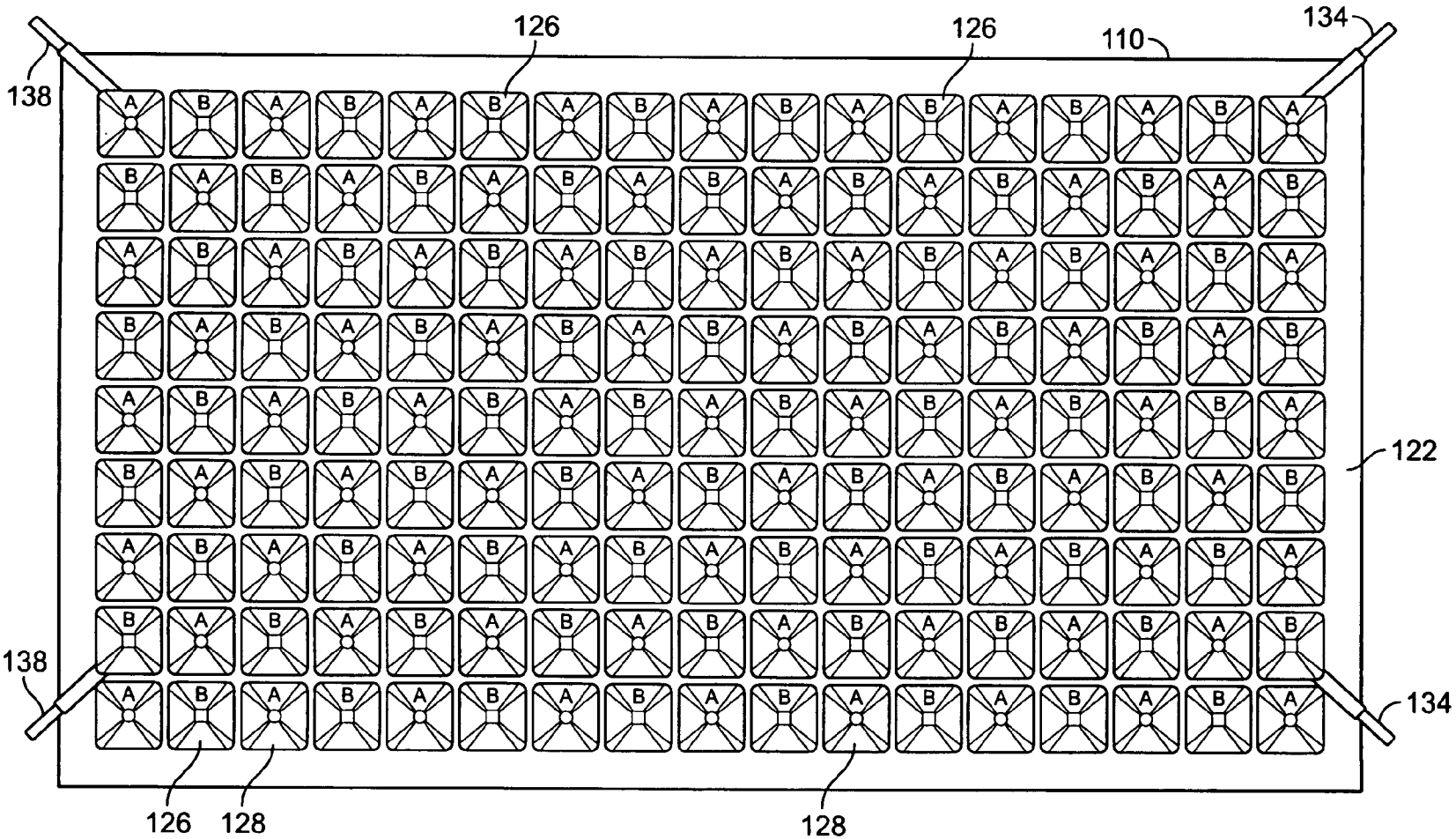
FIG. 18 is a bottom view of another embodiment of an alternating pressure mattress assembly.

Referring to FIGS. 7, 8 and 18, various embodiments of an activation section 116 are disclosed. The activation section 116 is configured to apply a therapeutic movement of cells 120. In one embodiment this comprises alternating pressure in alternating chambers of the mattress. IN another embodiment this comprises applying a percussive and/or vibratory force, including to a patient's torso region, however, it may also be utilized in other areas of the patient support layer 110, such as the thoracic area. The activation section 116 has an array of cells 120 that are similar to that found in the head, torso and lower body sections 112, 114, 118. The top walls 126 of the cells 120 collectively define a support and engaging surface 127 of the activation section 116. In a preferred embodiment the cells 120 within the activation section 116 are separated into at least two groups—Group A and Group B—whereby alternating pressure, alternating percussion and/or vibration and/or a flotation force is applied to the patient on a per group basis. As shown in FIGS. 8 and 18, the cells 120 in Group A are in fluid communication with each other by a number of channels 140, and the cells 120 in Group B are in fluid communication with each other by a number of channels 142, but the cells in Group A are not in fluid communication with the cells in Group B. In a preferred embodiment, the channels 140, 142 connect to the lower portion 128 of each cell 120. As a result of the fluid communication, the Group A cells 120 define a first fluid passageway for the supply and distribution of air to the cells 120 within Group A. Similarly, the Group B cells 120 define a second fluid passageway for the supply and distribution of air to the cells 120 within Group B. Accordingly, air can be supplied and distributed to the groups as needed for percussion, vibration, alternating pressure or a flotation/static state. Due to the array of cells 120, in different embodiments both the Group A channels 140 and the Group B channels 142 may have internal and external segments, meaning some channel segments are within the cell array and some channel segments that are near the periphery of the base 122, however other orientations may be different. Some segments of the channels 140, 142 are directed along diagonals, while other segments are linear and are positioned along the periphery of the base 122.

The activation section 116 also includes an air supply fitting 134 for each channel 140, 142, whereby air can be selectively supplied and distributed through the fitting 134 to a group. In this manner, the blower assembly 310 or other supplier of air supplies air initially to a lead cell 120 and the air is distributed to the remaining cells 120 in the group via the channels 140, 142. The activation section 116 includes an exhaust or relief fitting 138 for each group that permits air to be exhausted through the alternating valve assembly 410 during the percussion and/or vibration modes. As explained in greater detail below, when the bed system 10 is in the percussion mode and/or vibration mode, in one embodiment the blower assembly 310 supplies air through the fitting 134 to cells 120 in both Groups A and B, however, air in Groups A and B is alternately exhausted through the fitting 138 in controlled manner by the valve assembly 410. While the blower assembly 310 constantly supplies air, the valve assembly 410 exhausts air in an alternating manner from cells 120 in one of the Groups A and B to provide the percussion and/or vibration desired by the operator. Alternately, in the alternating pressure mode the blower assembly 310 generally provides air to increase the pressure in one of the groups of cells 120 while air is exhausted from the other group of cells, and then alternates to provide air to the previously exhausted group of cells and exhaust air from the previously inflated group of cells 120. As shown in FIGS. 7 and 8, in one embodiment the activation section 116 has a four by four array of cells 120 providing a square configuration to the section 114, however, the configuration can be altered depending upon design parameters including the size of the cells 120 and the dimensions of the activation section 116. For example, as shown in FIG. 18 an alternating pressure activation section 116 may be a full size mattress. Although the activation section 116 is only shown as having the cell Groups A and B, other sections within the patient support layer 110 may be so configured.

The patient support layer 110 can include an alternate array of cells 720, wherein each cell 720 has an upper sub-cell member, a middle sub-cell member and a lower sub-cell member. Collectively the upper, middle and lower sub-cell members define a cell stack 721. The alternate array of cells 720 and the cell stack 721 can be utilized in any section of the patient support layer 110, including the head section 112, the torso section 114, the activation section 116 and/or the lower body section 118. FIGS. 7A-D provide an example of one embodiment of a cell stack 721 as depicted in an alternate activation section 716. As mentioned above, the cell stack 721 has an upper sub-cell member 717, a middle sub-cell member 718 and a lower sub-cell member 719, wherein the lower sub-cell 719 is joined to the base layer 722. It is understood that additional or less sub-cell members may be utilized without departing from the scope of the present invention. Of course, the cell stack 721 dimensions vary with the design of the sub-cell members 717, 718, 719. The sub-cell members 717, 718, 719 have a height of roughly 1.5 to 2.5 inches, causing the cell stack 721 to have an overall height ranging between 4.0 and 12.5 inches, however taller or shorter cell stacks may also be utilized. Generally, each sub-cell member 717, 718, 719 has an upper portion 724 and a top wall 726. In the upper sub-cell 717, the top wall 726 defines a patient support surface 727, that is the means of percussion and/or vibration and/or flotation for the patient. Therefore, the patient support system 110 does not require a percussion and/or vibration means separate from the cell stack 721. A lower portion 728 of each sub-cell member 717, 718, 719 has a side wall arrangement 730. The cells 720 and the cell stack 721 are made from thermoformed plastic or a similar material. As an example of the formation process, the sub-cell members 717, 718, 719 are individually thermoformed, joined together to form the stack 721 and then the stack 721 is connected to the base 722, such as via radio frequency welding. Additionally, the base 722 can be preformed with raised segments or channel segments therein.

Figure 7B:
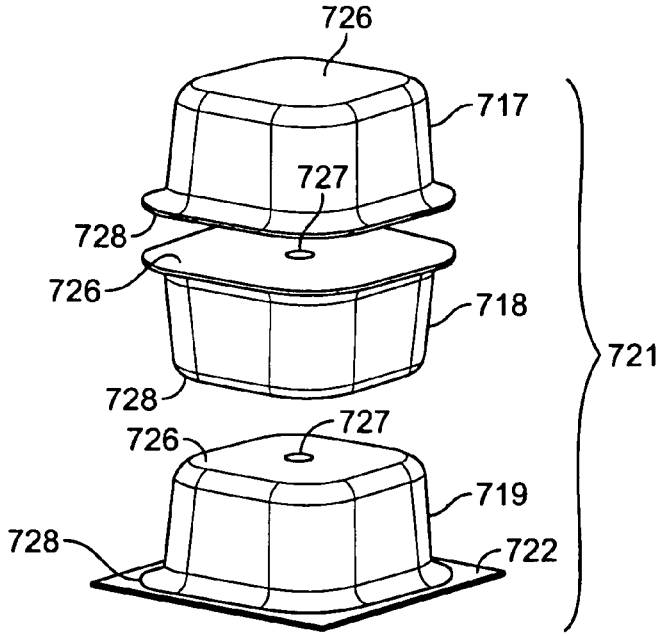
FIG. 7B is an exploded view of a portion of the array of patient support cells.

As shown in FIG. 7B, the upper sub-cell member 717 is positioned over the middle sub-cell member 718, and the middle sub-cell member 718 is positioned over the bottom sub-cell member 719. The bottom sub-cell member 719 is sealed to the base layer 722 along the sealing line 723 (see FIG. 7D). Referring to FIG. 7B, in one embodiment each sub-cell member 717, 718, 719 has at least one orifice 727 that is operably connects that sub-cell to the adjoining sub-cell or sub-cells. The operable connection of the sub-cells 717, 718, 719 via the orifices 727 defines a fluid passageway for the transmission of air from the lower sub-cell 719 through the middle sub-cell 718 to top sub-cell 717. The top sub-cell 717 contains at least one orifice 727 (not shown in FIG. 7B) in a bottom wall 728 of the cell 720. Each middle sub-cell 718 has a top wall 726 with an orifice 727 that is aligned with the orifice 727 in the top sub-cell 717 to define one segment of the cell stack fluid passageway. Each middle sub-cell 718 has a bottom wall with an orifice 727 that is aligned with the orifice 727 in the bottom sub-cell 710 to define the remaining segment of the cell stack fluid passageway. As mentioned above, the passageway allows air to be transmitted between the sub-cells 717, 718, 719 of the cell stack 721.

In another embodiment of the cell stack 721, the middle sub-cell 718 is replaced by at least one tube (not shown) in fluid communication with the orifices 727 in the top sub-cell 717 and the lower sub-cell 719. Therefore, the tube facilitates the exchange of air between the top and bottom sub-cells 717, 719. In yet another version of the cell stack 721, the sub-cells 717, 718, 719 lack the orifice 727 and instead have a breathable fabric layer that allows for the passage of air between two or more sub-cells.

Figure 7C:
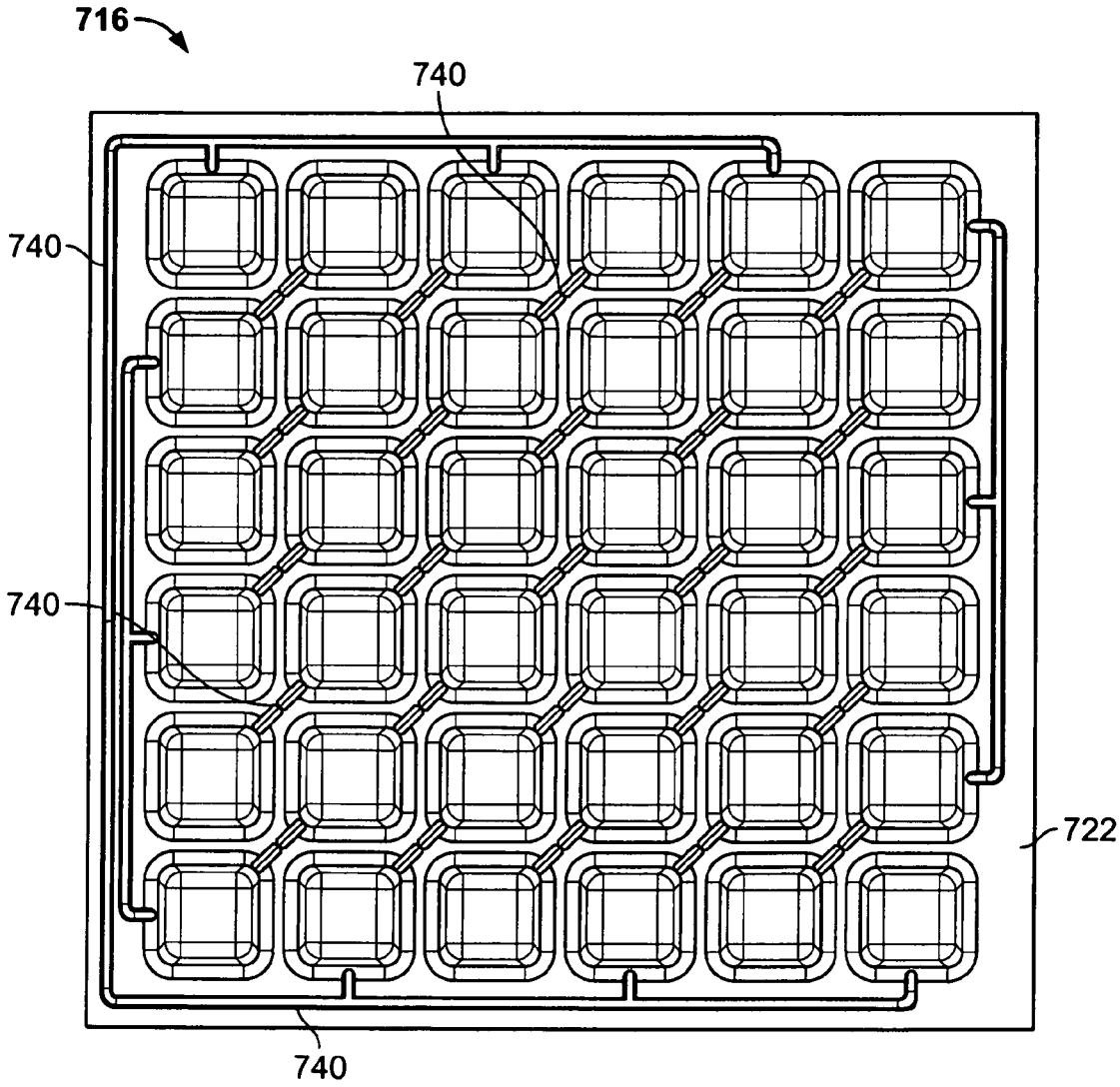
FIG. 7C is a top plan view of the array of patient support cells of FIG. 7A.
Figure 7D:
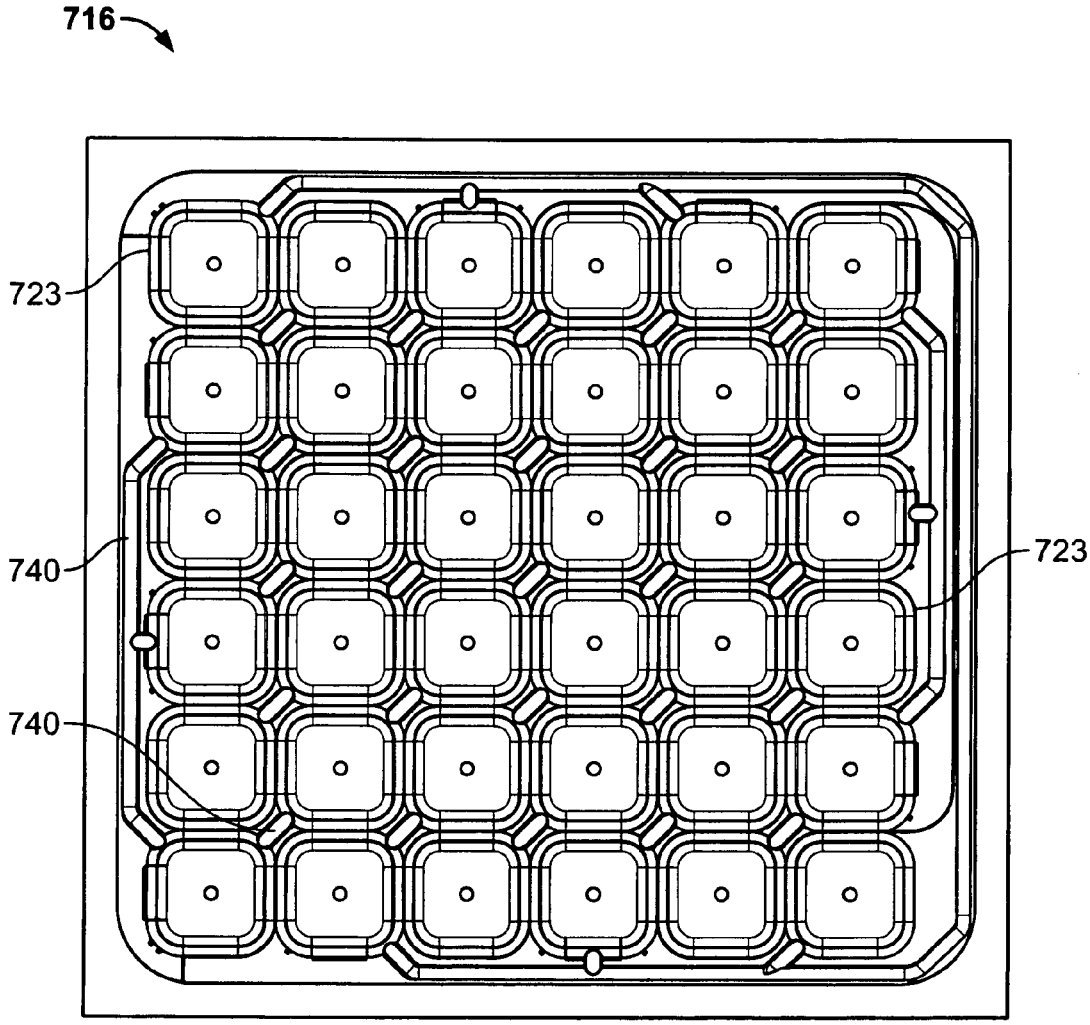
FIG. 7D is a bottom plan view of the array of patient support cell of FIG. 7A.

Similar to the cells 120 in the embodiment of the activation section described above, the cell stacks 721 within the activation section 716 are separated into at least two groups—Group A and Group B—whereby alternating pressure, percussion and/or vibration force, alternating pressure and/or flotation force is applied to the patient on a per group basis. As shown in FIGS. 7C and D, the cell stacks 721 in Group A are in fluid communication with each other by a number of channels 740, and the cell stacks 721 in Group B are in fluid communication with each other by a number of channels 742, but the cells in Group A are not in fluid communication with the cells in Group B. The channels 740, 742 generally connect to the lower sub-cell 719 of each cell stack 721 within the group. As a result of the fluid communication, the Group A cell stacks 721 define a first fluid passageway for the supply and distribution of air to the sub-cells 717, 718, 719 within Group A. Similarly, the Group B cell stacks 721 define a second fluid passageway for the supply and distribution of air to the sub-cells 717, 718, 719 within Group B. Accordingly, air can be supplied and distributed to the groups as needed for alternating pressure, percussion, vibration, or a flotation/static state. In general, air is supplied from the channel 740 though the lower sub-cell 719 and the middle sub-cell 718 to the upper sub-cell 717.

As shown in FIG. 2, in one embodiment a plenum layer 210 is utilized. In such an embodiment the plenum layer 210 is generally positioned below the patient support layer 110. In alternate embodiments the plenum layer is not utilized and the cells of the patient support layer are plumbed directly from the blower. The plenum layer 210 has a bladder assembly 211 with a first air bladder 212 that distributes air to and receives air from the head section 112, a second air bladder 214 that distributes air to and receives air from the torso section 114, and a third air bladder 216 that distributes air to and receives air from the lower body section 116. The first air bladder 212 is operably connected to the second air bladder 214 by a seam, and the second air bladder 214 is operably connected to the third air bladder 216 by a similar seam, both seams providing rigidity for the plenum layer 210.

The blower assembly 310 supplies air to the first air bladder 212 through a primary channel 220 that longitudinally extends through the second and third bladders 214, 216 and a collection of flexible supply lines 222. Air is distributed from the first air bladder 212 through a fitting 224 to the head section 112. The blower assembly 310 supplies air to the second air bladder 212 through a secondary channel 226 that longitudinally extends through the third bladder 216 and a collection of flexible supply lines 228. Air is distributed from the second air bladder 214 through a fitting 230 to the torso section 114. Instead of utilizing a channel 220, 226, the blower assembly 310 supplies air directly to the third air bladder 214 through a flexible supply line 232. Air is distributed from the third air bladder 216 through a fitting 234 to the lower body section 116. The primary and secondary channels 220, 226 can be welded by a drop-stitch technique to increase their strength and durability.

The blower assembly 310 supplies air to the activation section 116 through a pair of tubes 240, 242 that extend longitudinally along the third bladder 216 and an extent of the second bladder 214. Specifically, a first tube 240 supplies air from the blower assembly 310 through a fitting 244 to the Group A cells 120, and a second tube 242 supplies air from the blower assembly 310 through a fitting 244 to the Group B cells 120. In an another embodiment, the first and second tubes 240, 242 are replaced by a channel 220, 226 described above. A layer of foam may placed over the plenum layer, including the fittings, tubes and channels, to increase the patient comfort levels. The blower assembly 310 can include valve means, such as a one-way valve, to maintain a constant or static pressure in any of the bladders 212, 214, 261 and the activation section 216. It is understood, however, that any of the plenums may be eliminated or replaced with tubing directly from the blower/air supply to the cells.

Figure 21:
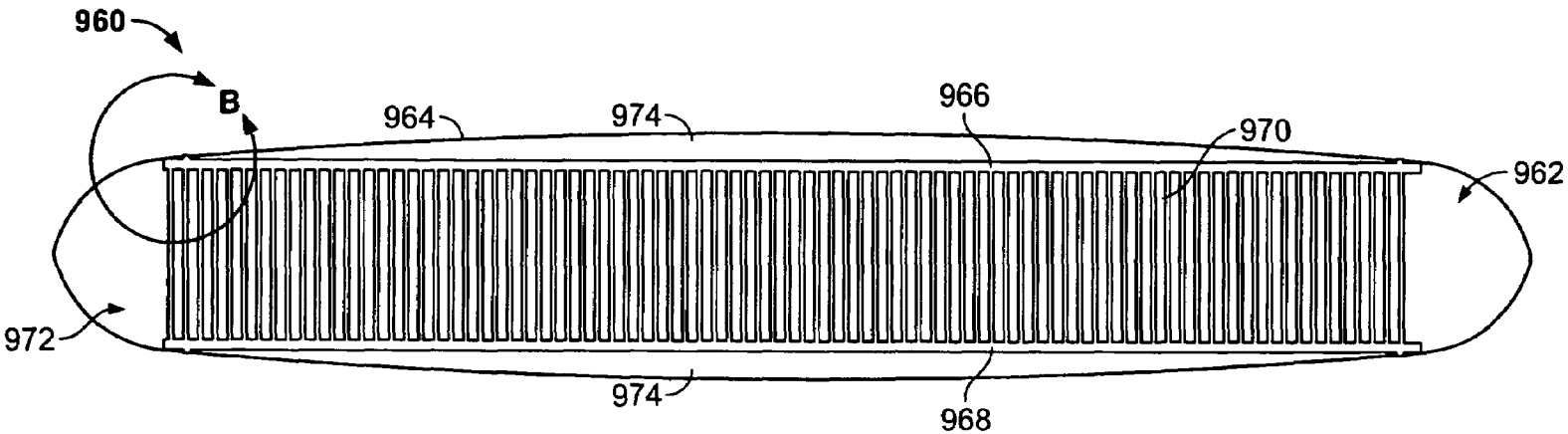

An alternate plenum layer 960 is provided in FIG. 21. In that embodiment, the plenum 960 includes an internal bladder member 962 encased in the outer plenum layer 964. The internal bladder member 962 comprises a stringed material, such as a netting or webbing, having a first layer 966, an opposing second layer 968 and internal cross-members 970 connecting the first and second layers 966, 968. The internal cross-members 970 maintain the first and second layers 966, 968 at a maximum spread distance therebetween. Accordingly, a thinner plenum is a resultant of this structure. Typically, the first and second layers 966, 968 of the internal bladder member 962 are backed with a urethane or other type material to make them substantially impervious to air flow therethrough. The internal bladder member 962 is encased in the outer plenum layer 964, thereby creating an internal plenum cavity 972. During such encasing, the outer plenum layer 964 is sealed to the first and second layers 966, 968 as shown in Detail B of FIG. 21. Further, additional cavities 974 are created between the outer surfaces of the first and second layers 966, 968 and the inner surface of the outer plenum layer 964. These additional cavities may be utilized as additional air bladders or plenums, or them may be utilized as a cavity to house tubing directed to different components of the system 10.

Figure 9:
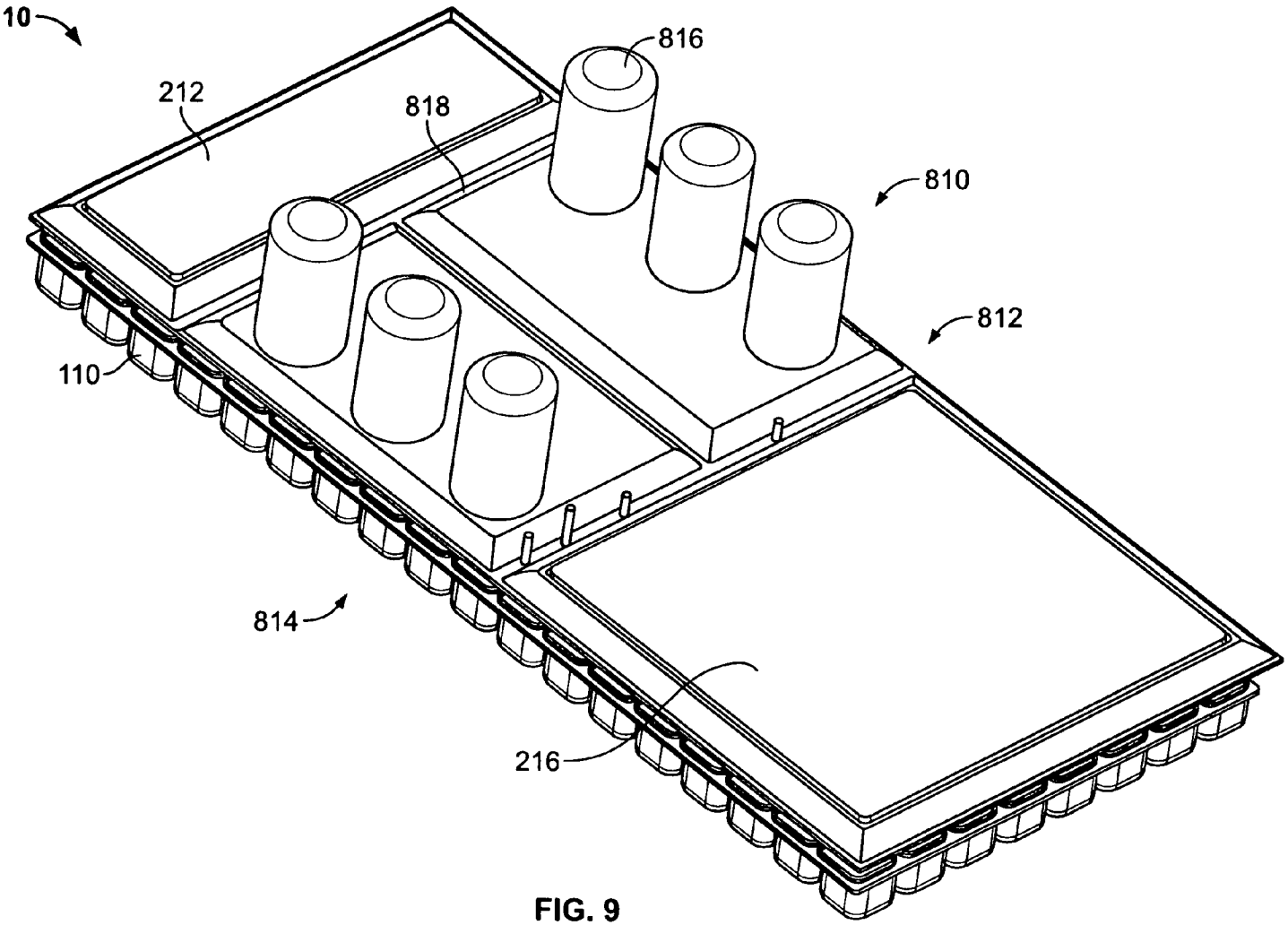
FIG. 9 is a perspective view of the bed system showing rotational elements extending from an underside of the patient support layer.

As shown in FIG. 9, the bed system 10 may also include a rotation assembly 810, typically having a left rotation element 812 and a right rotation element 814. In the embodiment reflected in FIG. 9, the rotation elements 812, 814 comprise a plurality of inflatable bladders, herein shown as posts 816. In one embodiment the rotation assembly 810 is positioned between the first air bladder 212 and the third air bladder 216 in the plenum layer 210. A central seam 818 bisects the elements 812, 814 to aid with the rotational operation of the assembly 810. A chord extending through the center of each group of posts 816 is parallel to the seam 818. Alternatively, a single bladder 816 may be utilized for each rotation element 812, 814, wherein the bladder 816 is placed on its side and it longitudinal axis is parallel to the seam 818. Preferably, the left and right rotation bladders are positioned below a lower surface of the torso section 114 whereby rotation is conducted on a per-side basis of the plenum layer 210. The left and right air elements 812, 814 can be a single inflatable bladder or multiple bladders each capable of having a variety of configurations, including rectangular, square, triangular, circular, etc. Similar to the first, second and third air bladders 212-216, the blower assembly 310 or some other supply of air supplies air to the left and right rotation bladders. In another embodiment, the left and right rotation bladders each comprise a number of smaller bladders that function as a rotation unit for rotation of each side portion of the patient support layer 110.

Figure 10A:
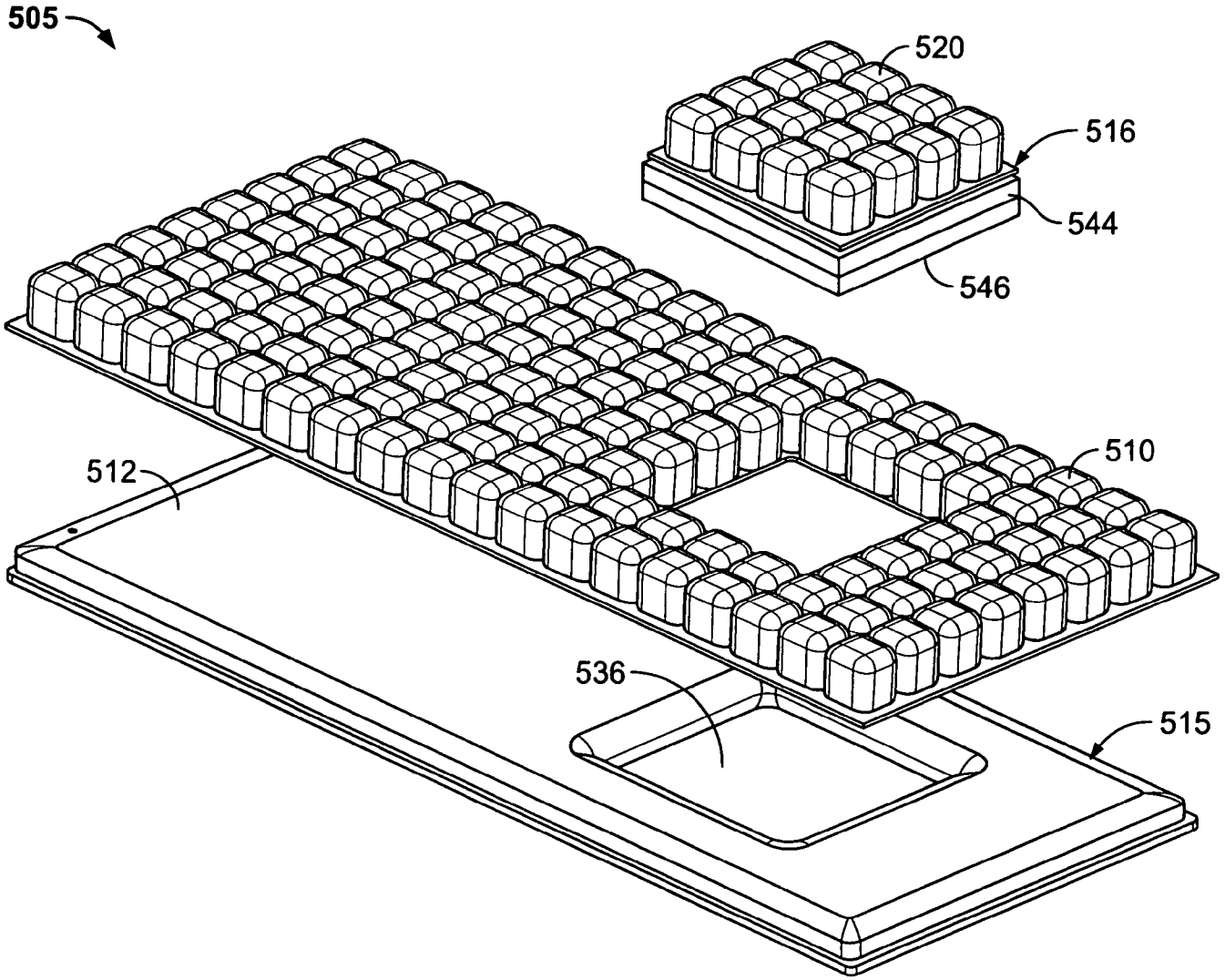
FIG. 10A is a perspective view of another embodiment of a therapeutic bed system showing the activation section and the patient support layer exploded from the plenum layer.
Figure 10B:
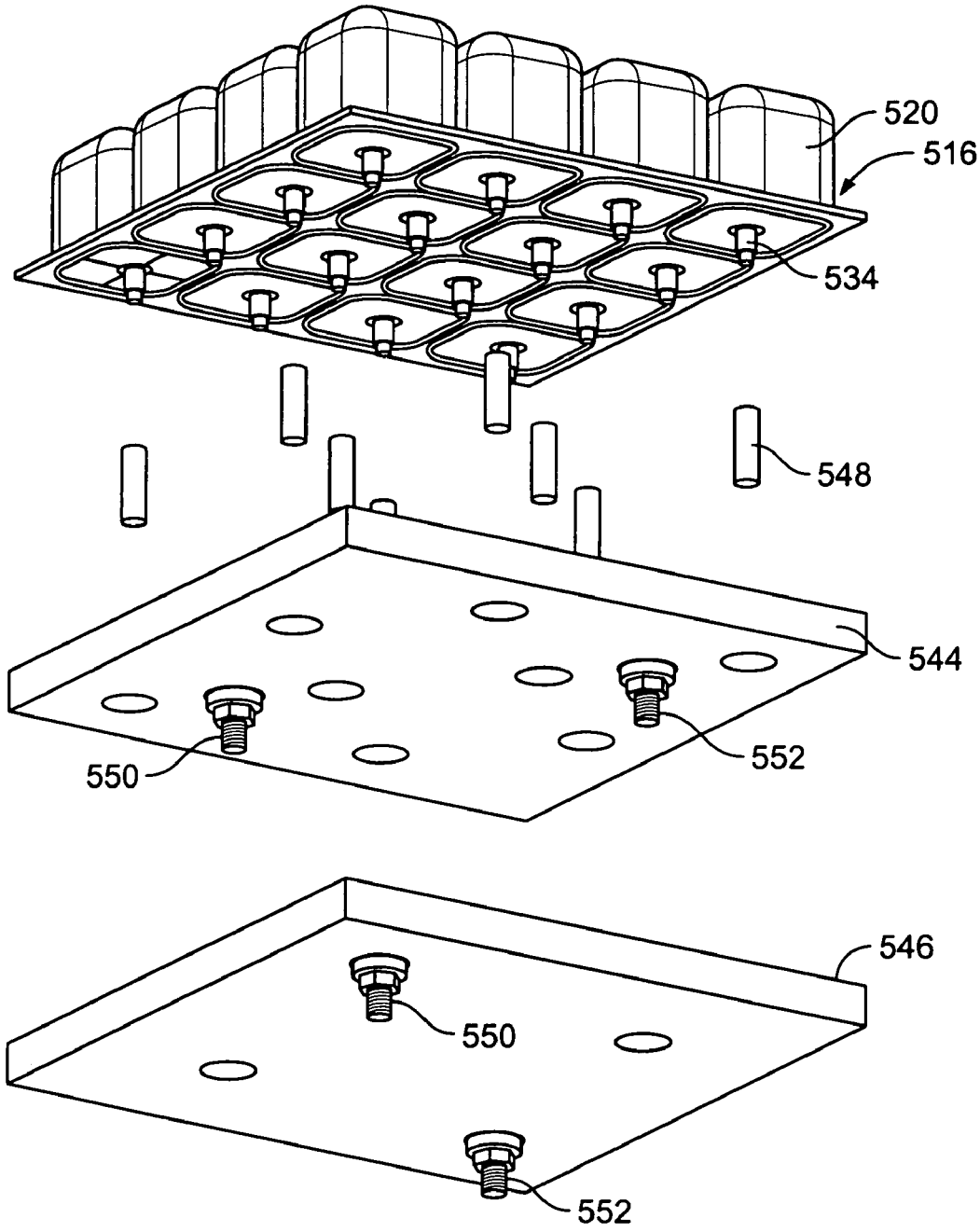
FIG. 10B is a perspective view of the activation section of FIG. 10A having two plenum chambers.

FIGS. 10A and 10B depict an alternate bed system 505, wherein the bed system 505 includes an activation section 516 operably connected to a pair of chambers 544, 546. Instead of distinct multiple bladders, the plenum layer 515 has a single bladder 512 with an opening 536 to receive the chambers 544, 546. The activation section 516 includes an array of cells 520 wherein each cell 520 has a depending fitting 534 for fluid connection with one of the chambers 544, 546. The activation section also includes Group A and Group B cells. The Group A cells 520 are in fluid communication with the chamber 544 through the fittings 534. The chamber 544 has a supply fitting 550 for the supply of air from the blower assembly 310 and an exhaust fitting 552 for the discharge of air from the chamber. The Group B cells 520, through the fittings 534 and an extension piece 548, are in fluid communication with the chamber 546. Like the chamber 544, the chamber 546 has a supply fitting 550 for the supply of air from the blower assembly 310 and an exhaust fitting 552 for the discharge of air from the chamber. Therefore, the chambers 544, 546 act as smaller plenums for the supply and/or exhaust of air from Group A and B in the activation section 516. When the activation section 516 and the chambers 544, 546 are in an assembled position, the chamber 544 for Group A is positioned between the activation section 516 and the chamber 546 for Group B.

Figure 11:
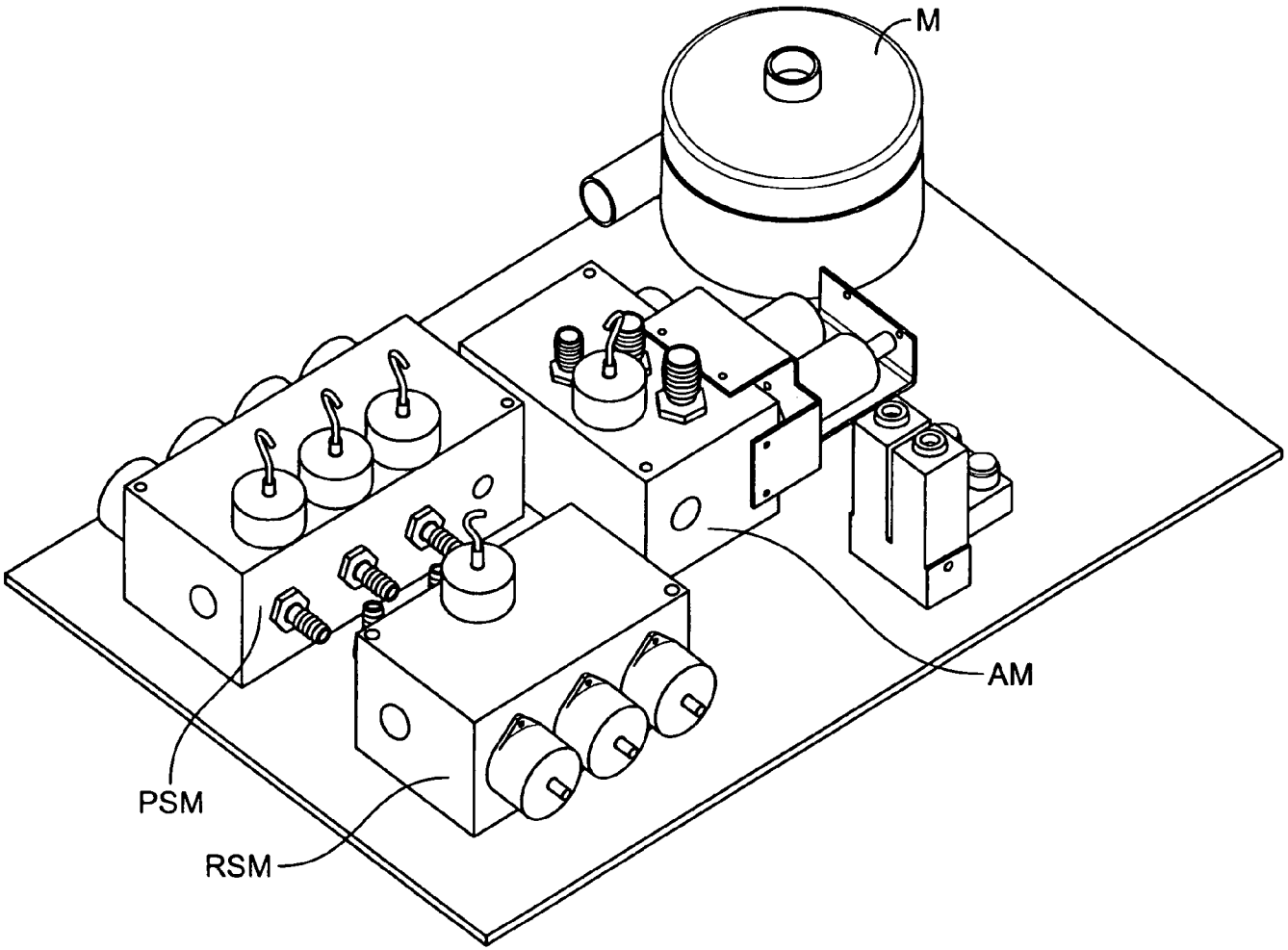
FIG. 11 is a perspective view of a blower assembly of the bed system.

As shown in FIG. 11, one embodiment of a blower assembly 310 for an embodiment of the bed system 10 includes a number of components to supply air to the patient support layer 110 and/or the plenum layer 210. These components include a blower or pump, a number of control valves and manifolds, a power supply (typically supplying 120 VAC), pressure transducers and other components associated with the air supply and zone controls. Preferably, the blower assembly 310 is mounted to the standard bed frame or support structure without modification. The actual blower can be sized to provide a sufficient amount of air to the support layer 110 for a patient weighing up to 1,000 pounds. As explained above, the blower may be an appropriately sized pump. The blower assembly 310 is configured to communicate with a combined control panel and user interface (not shown) such that an operator can control the operation of the blower assembly 310 and the settings of the bed system 10. Depending upon the settings entered by the operator in a control panel or other control member, the blower assembly 310 can supply air on a substantially constant basis to the plenum layer 210 and the patient support layer 110 through passageways, such as supply lines 222, 228, 232 and the tubes 240, 242. While the blower assembly 310 supplies air to the plenum and support layers 110, 210, the activation valve assembly 410 controls the quantity of air exiting the activation section 116. The blower assembly 310 can be mounted to any portion of the bed frame or the support frame for the bed assembly. Alternately, the blower assembly 310 can be utilized without an activation valve assembly 410 and monitor and supply or exhaust air as needed from each group of cells as required by the specific therapy. For example, in an alternating pressure therapy the blower assembly 310 may supply from approximately 20 mm. Hg. to approximately 32 mm. Hg. in the pressurized group of cells 120 and may entirely exhaust the air pressure in the other group of cells 120.

Figure 17:
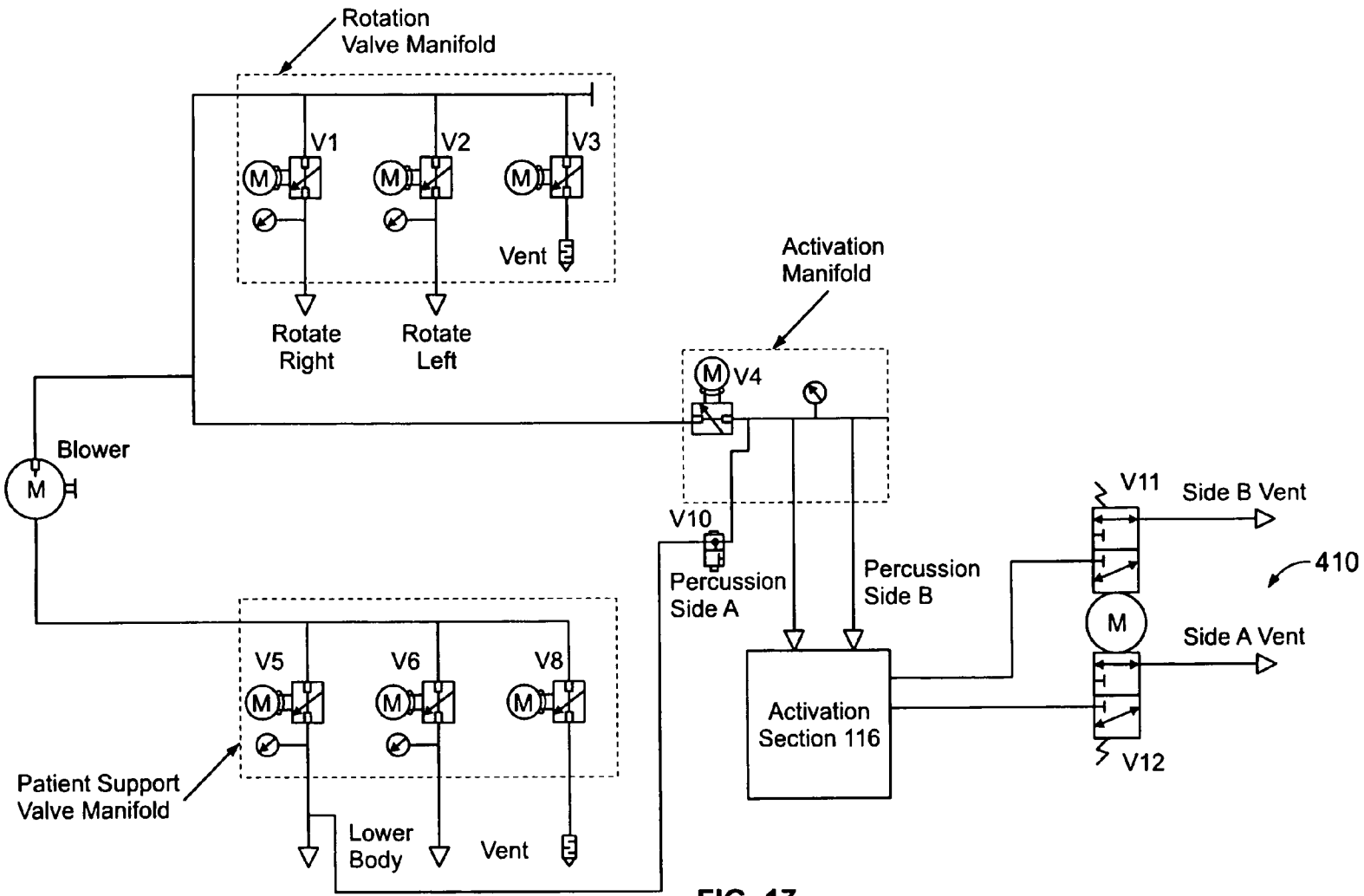
FIG. 17 is a schematic of the valve assembly of the bed system.

Referring to the schematic of FIG. 17, in one embodiment, the blower assembly 310 includes a valve assembly 312 with a number of valves and at least one manifold. In general terms, in one assembly the blower assembly 310 includes the blower M; a rotation valve manifold RVM having left and right rotation valves V1, V2 and a vent valve V3; a patient support manifold PSM having a valve V5 for the head and torso sections 112, 114, a valve V6 for the lower body section 118 and a vent valve V8; and, an activation manifold AM having a flow control valve V4 and a torso to percussion/vibration crossover valve V10. The valves V4 and V10 are operably linked with the activation section 116 for alternating pressure, percussion and/or vibration. The precise number and type of valves varies with the design parameters of the bed system 10, including the patient support layer 110, the activation section 116, and the plenum layer 210. The schematic also includes the activation valve assembly 410 that is operably connected to the activation section 116 to control the exhaust of air from Group A and Group B cells 120 in the activation section 116. It is understood that other types of blowers/valves may be utilized to perform the functions described herein.

As explained above, in one embodiment of the blower assembly 310 an activation valve assembly 410 is utilized. The activation valve assembly 410 shown in FIGS. 12-16 is configured to control the quantity of air discharged or exiting the cells 120 of Groups A and B in the activation section 116. In one embodiment, the valve assembly 410 includes a first valve 420 and a second valve 424 in opposed positional relationship. The first valve 420 is in fluid communication with the Group A exhaust fitting 138 by a flexible line 422, and the second valve 424 of the assembly 410 is in fluid communication with the Group B exhaust fitting 138 by a flexible line 422. Each valve 420, 424 has a vent 428 configured to release or vent air discharged from the Group A and B cells 120 in a controlled manner to ambient. Described in a different manner, the valve assembly 420 controls the quantity and pressure of air in Groups A and B for treatment purposes, including alternating pressure, percussion and vibration treatment.

Figure 12:
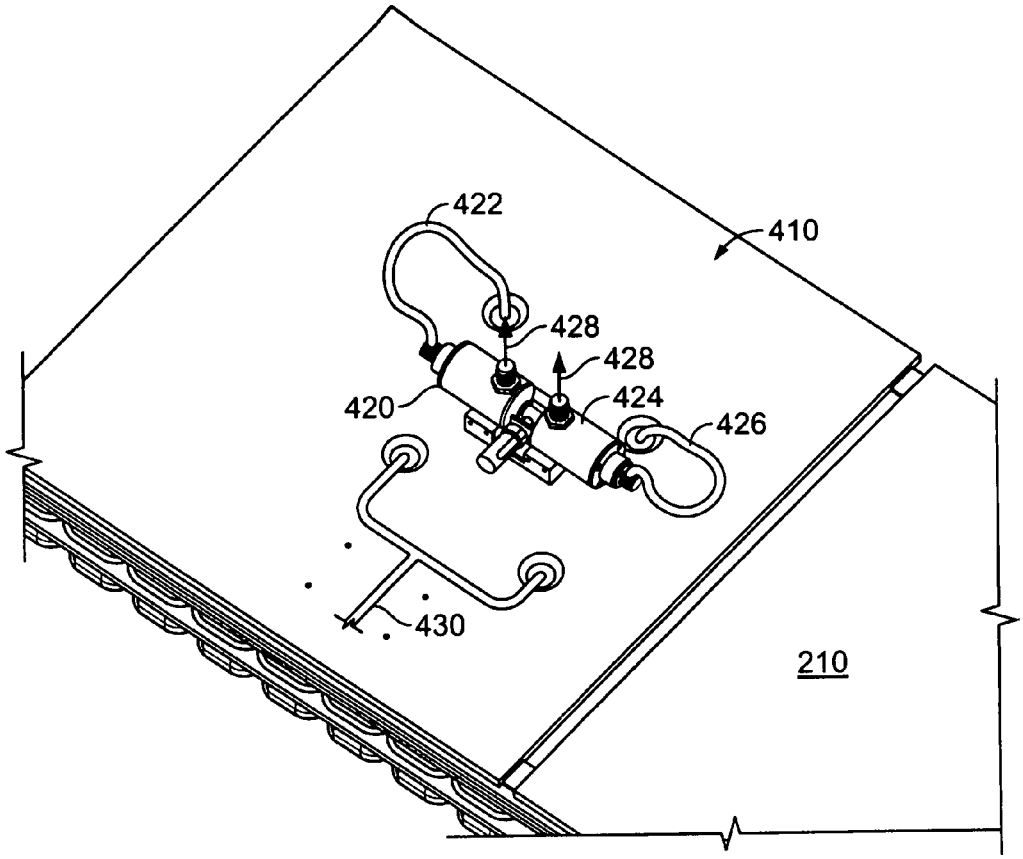
FIG. 12 is a perspective view of an activation valve assembly mounted to a lower surface of the plenum layer.

Referring to FIG. 12, in one embodiment the valve assembly 410 is mounted to a lower surface of the plenum layer 210. The plenum layer 210 can include a substantially rigid support base and the valve assembly 410 can be mounted thereto. The lines 430 represent air supply lines to the activation section 116, namely Groups A and B. Referring to the schematic of FIG. 17, the valve assembly 410 controls the discharge of air from the activation section 116 while the blower assembly 310 supplies air to the activation section 116. The valve V11 in the schematic corresponds to the valve 420 and the valve V12 corresponds to the valve 424.

Figure 13:
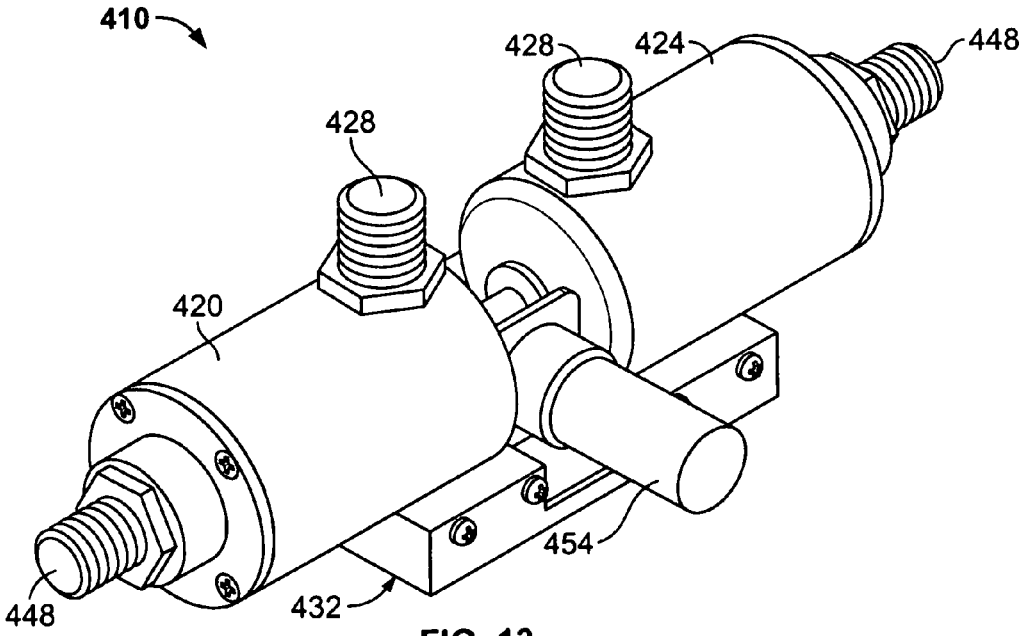
FIG. 13 is a perspective view of the activation valve assembly.
Figure 14:
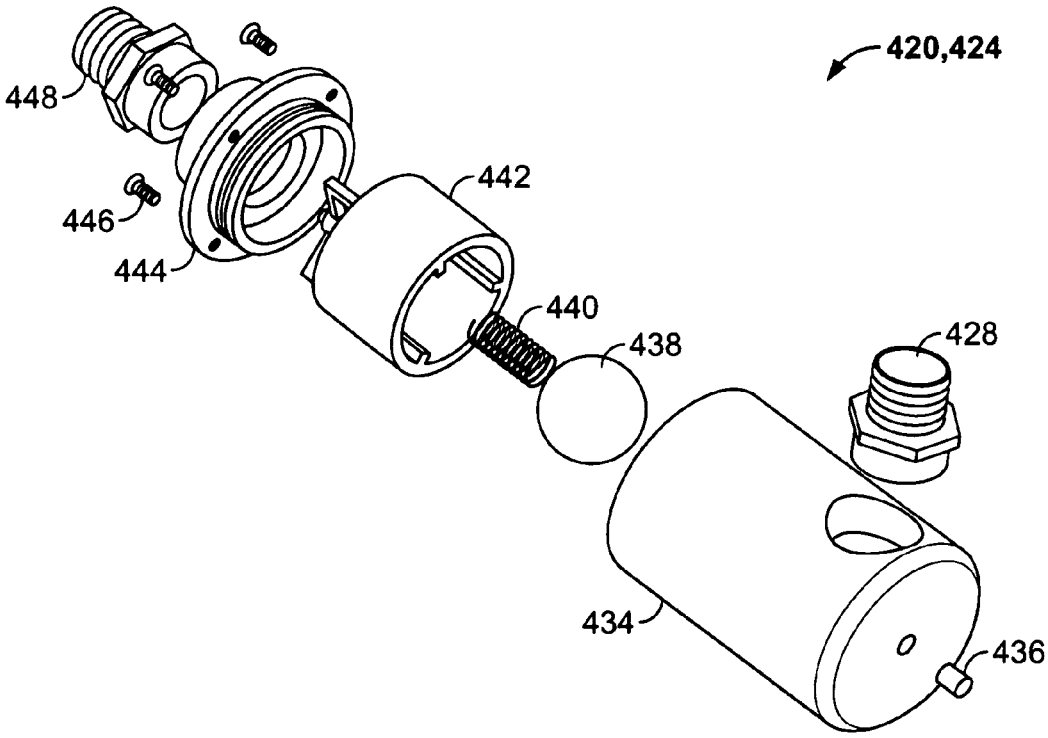
FIG. 14 is an exploded view of the activation valve assembly.
Figure 15:
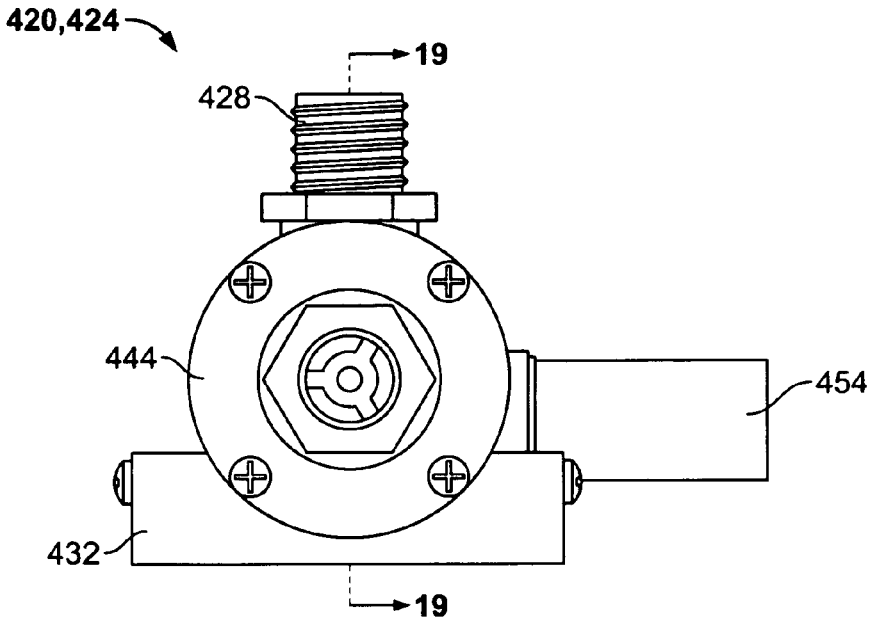
FIG. 15 is an end view of the activation valve assembly.
Figure 16:
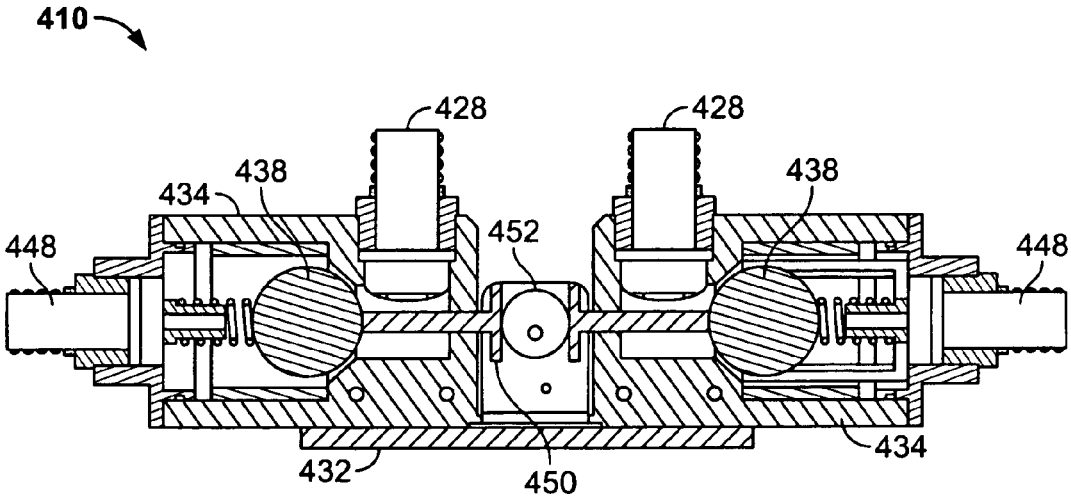
FIG. 16 is a cross-section of the activation valve assembly taken along lines 16-16 of FIG. 15.

As shown in the embodiment FIG. 13, the valve assembly 410 includes two distinct valves 420, 424 that are affixed to a mounting plate 432. Referring to FIG. 14, the valves 420, 424 have a similar construction wherein each valve 420, 424 includes: a vent fitting 428, a valve body 434, a bearing 436, a ball valve 438, a spring 440, and a guide 442. The valve 420, 424 further includes a cap 444 and fasteners 446 to secure the cap 444 and secure the valve body 434. Inlet fitting 448 is in fluid communication with flexible lines 422, 426 which distribute air from cells 120 of Groups A and B to the valve assembly 410. Specifically, exhausted air from Group A is supplied to valve 420 via the flexible line 422, while exhausted air from Group B is supplied to valve 424 via the flexible line 426. Therefore, there is preferably a 1:1 relationship between a group and a valve 420, 424. As shown in FIGS. 15 and 16, each valve 420, 424 has a plunger 450, wherein the plungers 450 are positioned on opposite sides of a cam 452, preferably an eccentric cam.

The alternating valve assembly 410 has been described above as having opposed valves 420, 424 wherein there is a 1:1 relationship between the valves 420, 424 and Groups A, B. In another embodiment, the valves 420, 424 are configured in a different positional relationship whereby air is exhausted from the cells 120 of Groups A and B in a similar manner as described above. For example, the valves 420, 424 can be distinct valves operated independently. In such an embodiment, one valve could be providing for vibration therapy in one of the activation cell groups, and the other valve could be providing for percussion therapy in the other activation cell groups. Alternatively, one of the valves could be providing alternating pressure, and flotation/static therapy. Similarly, the valves could be set for varying timing of the different therapies provided. Accordingly, it is understood that an unlimited variety of therapy and therapy timing combinations are possible with multiple independent valves for each activation cell group. In yet another embodiment, the valve assembly 410 includes a single valve 420 that is operably connected to Groups A and B, whereby the single valve 420 receives and exhausts air from cells 120 in both Group A and Group B. Further, it is understood that any valve assembly can be positioned within the blower box 310.

Figure 13A:
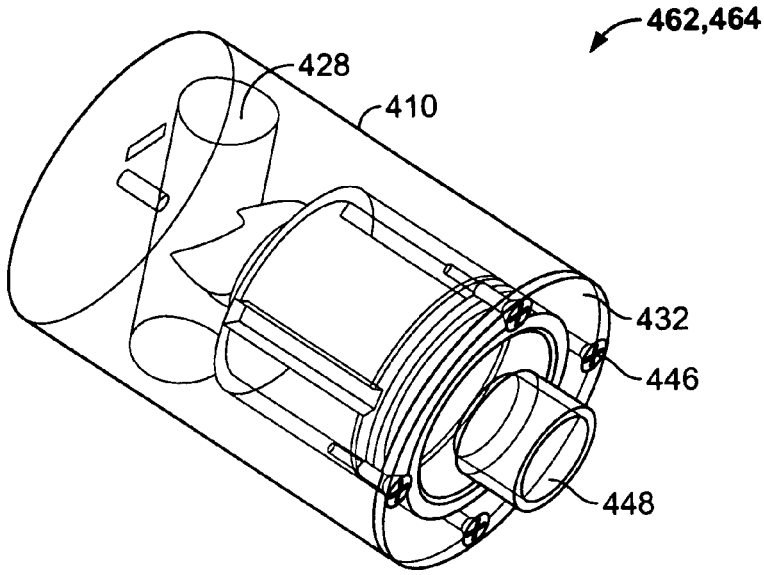
FIG. 13A is a perspective view of an alternate embodiment of the activation valve.
Figure 13B:
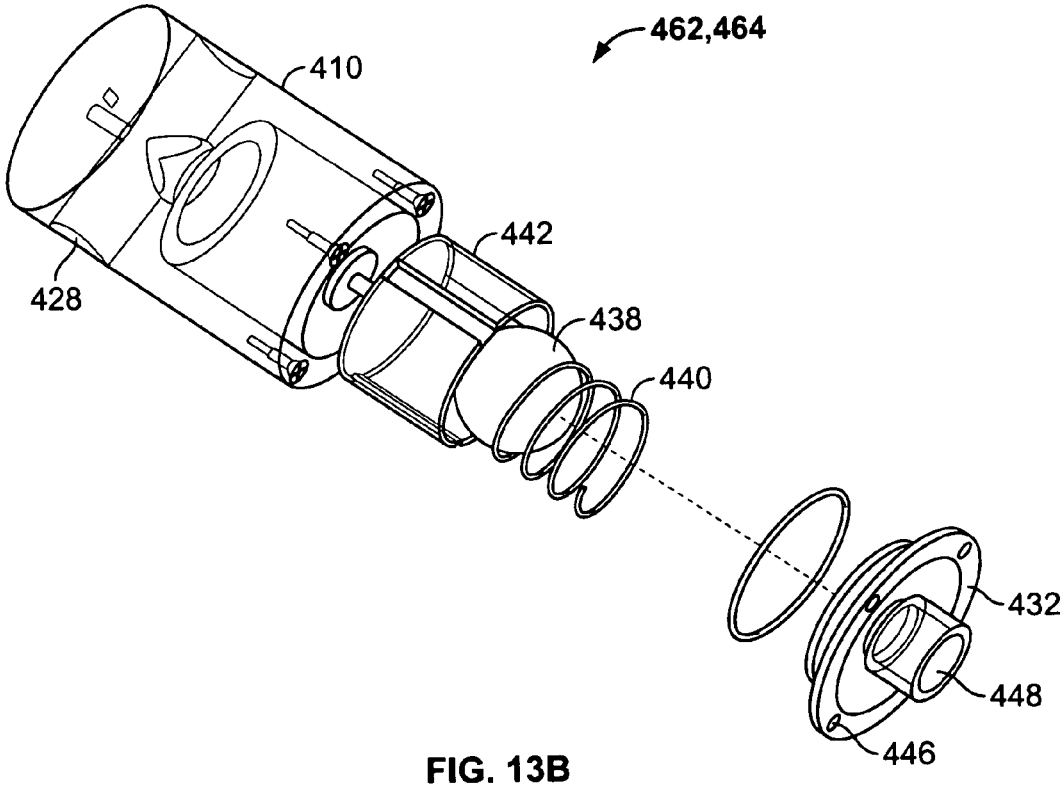
FIG. 13B is an exploded view of the activation valve of FIG. 13A.

FIGS. 13A and 13B show yet another alternative valve 462, 464 which can be used in the activation valve assembly 410. The alternative valve 462, 464 includes an inlet 448 which is connected to a plate 432. The plate 432 is connected with fasteners 446 to one end of a cylindrically shaped body of the activation valve assembly. Near the opposite end, the body contains an exhaust shaft 428 which extends through the entire body of the activation valve assembly 410. The body of the activation valve assembly 410 houses a guide 442 which surrounds a ball valve 438 and a spring 440. An O-ring is situated between the interior of the plate 432 and the spring 440.

In this embodiment air is supplied from Groups A and B in the activation section 116, or any other portion of the mattress, to one of the valves 420, 424 through the inlet fitting 448. A variable speed motor (not shown) typically drives the cam 452 which, through the plunger 450, unseats one of the balls 438 in an alternating manner, however, it is understood that other drive means, such as actuators or solenoids, may be utilized without departing from the scope of the present invention. The motor is connected to the cam 452 by coupling shaft 454. The unseating of the ball 438 and the attendant compression of the spring 440 allows air within the valve body 434 to flow past the ball 438 and to the outlet fitting 428 for discharge from the valve 420, 424. Once the motor has moved the cam 452 to its smallest position, the plunger 450 moves towards the cam 452 and the spring 440 re-seats the ball 438 to prevent air from reaching the outlet fitting 428. By varying the speed of the motor, the frequency of the valve 420, 424 opening and closing and the resultant discharge of air through the outlet fitting 428 can be increased or decreased. Due to the opposed configuration of the valves 420, 424, the valve assembly 410 alternates between venting the air from either Group A or Group B thereby causing the cells 120 in the other group to remain pressurized and exert a force on the patient. In this manner, the valve assembly 410 provides alternating cell group force application to a patient's thoracic region. As explained below in the operations section, the frequency at which the valve assembly 410 alternates determines whether alternating pressure, percussion or vibration is applied.

The therapy bed system 10 has several modes of operation, including standard, high pressure, alternating pressure, pulsation, percussion, vibration, rotation, flotation, wound therapy and any combination thereof. For example, the bed system 10 may include a combination of percussion and vibration, or a combination of rotation, percussion and vibration, etc. As another example, the bed system 10 can be placed in a high pressure state for emergency treatment of the patient, such as CPR. Additionally, the bed system 10 may be utilized for alternating pressure therapy. The precise number of operational modes is dependent upon the configuration of the bed system 10 and the end-users desired operating parameters.

In the standard mode, the blower assembly 310 supplies air to each of the head section 112, the torso section 114, the activation section 116 and the lower body section 118, while the activation valve assembly 410 is closed to retain generally constant air pressure with the sections 112-118. The air pressure level can be a default level or a level entered by an operator. In another version of the standard mode, different sections 112-118 can be maintained at different pressures. For example, the head and torso sections 112, 114 can be maintained at a first pressure while the lower body section 118 can be maintained at a second pressure. In this mode, the cells 120 and the support surface 127 acts as a local pressure reduction surface because the interconnecting cells 120 will self compensate or adjust to patient position to evenly distribute weight applied to the support surface 127.

In contrast to the standard mode, the percussion mode is a dynamic mode. While the blower assembly 310 supplies air to the cells 120 in Groups A and B of the activation section 116, the activation valve assembly 410 exhausts air in an alternating manner from Groups A and B thereby affecting the pressure with the Groups. As an example, when air is exhausted from Group A by the valve assembly 410, the cells 120 in Group A generally deflate (thereby reducing their overall height), and the cells 120 in Group B remain pressurized to support the patient. The cells 120 in Group B may experience an increase in pressure that increases their overall height resulting in a force applied to the patient. The exhaustion of cells in Groups A and B alternate as the cam 452 and the plunger 450 are actuated during operation of the valve assembly 410. Therefore, the controlled exhaust of air provided by the valve assembly 410 enables the cells 120 within the Groups A and B to provide alternating force applications to the patient. In this manner, the cells 120 and the support surface 127 provide the means of treatment to the patient, not a separate element. Accordingly, when the valve assembly 410 closes for a certain group during a percussion therapy, for example, the group receives an almost instantaneous pressure increase, thereby causing those cells in the group to "pop" as may be required by a given therapy regimen. The force application results a dynamic system with pneumatically powered cell groups where the pressure therein is actively adjusted by the valve assembly 410 and the control panel.

Depending upon the frequency of operation of the valve assembly 410 and the resulting air exhaustion, the applied force can be a pulsation force, a percussive force, a vibration force, a flotation/static force or a combination thereof. The percussive forces are intended to be roughly equivalent to a procedure that a nurse would perform on a patient to break loose phlegm from the walls of the lungs by cupping the hands and beating on the back in the lung area. The frequency resulting in a percussive force is roughly one to five beats or cycles per second. The manifold air pressure of the activation section 116 is roughly 46-56 mm Hg (25-30 inches of water), whereas during percussion or vibration the maximum pressure in the head, torso and lower body sections 112, 114, 118 is roughly 9-37 mm Hg (5-20 inches of water).

The blower assembly 310, the activation section 116 and the activation valve assembly 410 operate in a similar manner to provide the vibration mode. Thus, the valve assembly 410 exhausts air in an alternating manner from Groups A and B to provide the applied force explained. In contrast to percussion, the frequency resulting in a vibratory force is roughly 6-25 beats or cycles per second. The goal of the vibration mode is to move the phlegm that has been loosened by the percussion action so that it can be expectorated. As explained above, vibration and percussion can be combined in one treatment application to obtain the benefits of both therapies.

In the rotation mode, the patient is slowly rotated from side to side to facilitate the movement of fluid in the lungs so that it can be expectorated. The typical range of rotation is roughly 5 degrees to 60 degrees. Rotation occurs through the inflation and deflation of the bladders located beneath the torso section 114. Rotation can be used in conjunction with percussion and/or vibration to achieve greater fluid removal from the patient.

As identified herein, the therapeutic bed system 10 may be utilized for alternating pressure. In the alternating pressure mode the alternating cell 120 portion of the mattress may be the full size of the bed, or alternating cell activation sections 116 may be provided in a mattress made of additional cells 120 or of non-inflatable components, such as foam or gel. Additionally, the mattress 110 may be placed in a foam frame, may have a foam base member, and may be wrapped in a mattress cover for use on a hospital bed as described in related U.S. patent application Ser. No. 11/349,683. Typically, the cells 120 comprise a plurality of inflatable components such as soft, fluidly interconnected but independently movable, air-filled cells 120 which are grouped in groupings as described above. In a preferred embodiment two groupings of cells 120, Group A and Group B, are utilized, however it is understood that additional groupings of cells may be utilized with the alternating pressure mattress. In the alternating pressure mode, pressure is alternated between the cells of group A and the cells of group B. Further, the pressurized cells 120 of each group are able to redistribute air pressure between each of the cells 120 in the group to allow the cells 120 of the mattress 1200 to conform to the contours of a patient's body with minimal tissue deformation to provide a friction and shear relief surface. Rather than being non-powered, in the alternating pressure air mattress the cells 120 are provided in an open system in connection with a pump or blower assembly 310, preferably plumbed directly to the chambers of the air mattress.

The air cells 120 of the alternating pressure mattress 110 are generally arranged in an array of rows and columns. In a preferred embodiment the air cells 120 are elongated vertically and extend from the generally flexible base 122, in a tower-like configuration. The cross-sectional shape of the cells 120 may be square, rectangular, round or any other design that provides the proper qualities to the mattress 110. In a preferred embodiment, the inflatable components 60 are made of a durable neoprene rubber that is flame-resistant and can be easily cleaned. Additionally, in a preferred embodiment the air cells 120 extend approximately 3.5" from the base 122, however, in an alternate embodiment the cells 120 extend at least 2.5" from the base 122. When the mattress 110 is used alone on a bed the cells may have a height from 2.5" up to and including 10", however a typically mattress will have cells that are between 2.5" and 6.0". In another embodiment the air cells 120 are approximately 4.0" in height. Each of the cells 120 has a sidewall 128 and a top portion 126 defining a patient support surface 127. Further, each cell 120 has an interior cavity defined by the interior of the sidewall 128, the top portion 126 and the base 122. The cavities of the cells 120 of Group A, also referred to as the first group, are fluidly interconnected together to define a first group chamber, and the cavities of the cells 120 of Group B, also referred to as the second group, are fluidly interconnected together to define a second group chamber, with the first group chamber not being fluidly interconnected to the second group chamber. In one therapy the first group of cells has a volume of air and the other group of cells has a reduced volume of air.

The first group of cells 120 has an inlet port 134 and an exit port 138 to allow air to be injected into the first group of cells 120 at the inlet port 134 and to allow at least a portion of the air in the first group of cells 120 to be exhausted at the exit port 138 as appropriate for the alternating pressure therapy. Similarly, the second group of cells 120 has an inlet port 134 and an exit port to 138 to allow air to be injected into the second group of cells 120 at the inlet port 134 and to allow at least a portion of the air in the second group of cells 120 to be exhausted at the exit port 138 as appropriate for the alternating pressure therapy. The blower or pump 310 is in fluid communication with the inlet and outlet ports 134, 138 of the mattress 110 and supplies air pressure to the cells 120 as appropriate in the mattress 110. Alternatively, each of the group of cells 120 may have only an inlet port 134 and air may be able to be injected and exhausted from the same port 134 without requiring a separate exit port 138. In such an embodiment, the blower or pump 310 is in fluid communication with each of the inlet ports 134 and can supply and exhaust air therefrom.

As shown in FIG. 18, the cells 120 of the first group (i.e., the "A" cells) alternate across the mattress 110 with the cells 120 of the second group (i.e., the "B" cells), and preferably they alternate diagonally across the mattress 110. Referring to the FIG. 18, in a preferred embodiment the mattress 110 has a plurality of adjacent and opposing edges 131*a-d*. The cells 120 of the first group extend in a plurality of diagonal groupings from one edge of the mattress 110 to an adjacent edge of the mattress 110, and the cells of the second group also extend in a plurality of diagonal groupings from one edge of the mattress 110 to an adjacent edge of the mattress 100 depending on the size and configuration of the mattress 110. It is possible, however, depending on the configuration of the mattress that the cells may extend to an opposing edge of the mattress.

In a preferred embodiment, the alternating pressure mattress 110 operates with each group of cells 120 having independent equilibrium flotation capabilities with constant restoring forces. Accordingly, the individual cells 120 are adapted to move independently in at least six degrees of freedom, including both directions in the z-axis (i.e., up and down), both directions in the x-axis (i.e., side to side) and both directions in the y-axis (i.e., front to back). Further, in certain embodiments the individual cells 120 can twist, turn and bend to adapt to the contours and anatomy of the patient thereon. Further, when the patient is provided on the mattress 110 the patient is partially immersed in the cells. With such immersion the forces and pressures pushing back on the patient are kept equal at all times. More specifically, because each of the cells 120 in a group are fluidly interconnected, greater contact area is achieved for dispersion of pressure on the entire body and the forces and pressures pushing back on the patient on the mattress are kept substantially equal at all points on the patient. Thus, the pressure on any one areas of the body of a patient on the alternating pressure mattress 110 is minimized.

In an alternative therapeutic operation, all of the cells 120 of the mattress 110 may be inflated and deflated simultaneously, and typically cyclically, to raise and lower a patient thereon.

Figure 20:
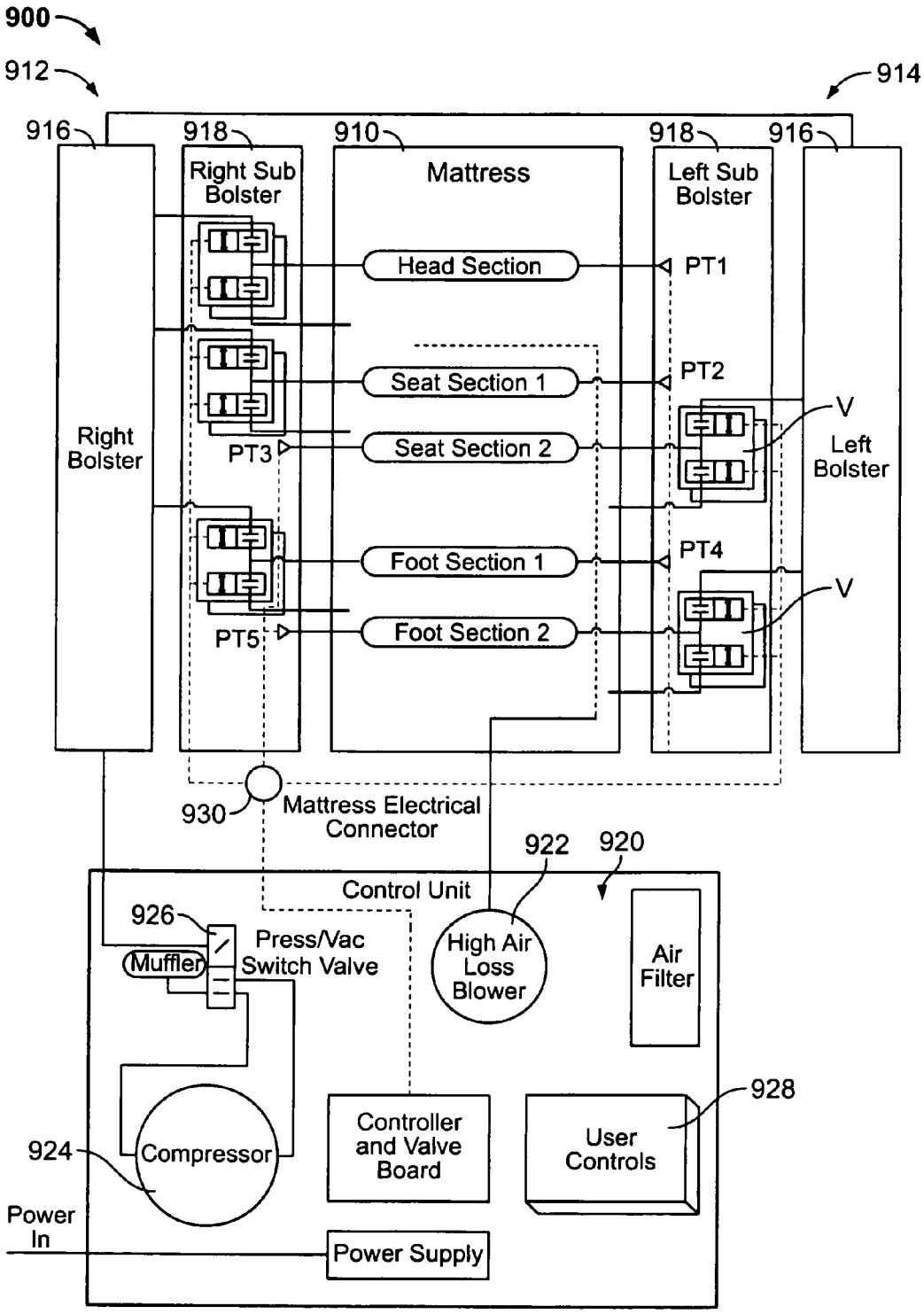
FIG. 20 is a block diagram of a replacement therapeutic mattress assembly; and, FIG. 21 is a cross-sectional schematic of one embodiment of a plenum utilized with the dynamic therapy bed system.

FIG. 20 provides a block diagram of another alternate mattress system 900, wherein the mattress provides therapeutic treatment to a patient. In this system 900, a mattress assembly 905 having and external cover encasing a mattress 910, a right bolster assembly 912 and a left bolster assembly 914, wherein each bolster assembly 912, 914 comprises a bolster 916 and a sub-bolster 918. Preferably, the bolster 916 of each bolster assembly is positioned above its respective sub-bolster 918. The overall height of the bolster assembly 912, 914 generally corresponds to that of the mattress 910, however alternate embodiments may be provided that are taller or shorter than the adjacent mattress 910. The system 900 further includes a control unit 920, that as explained below, is operably connected to the mattress 910 and the bolster assemblies 912, 914. Additionally, a controller (not shown) is typically electrically connected to the control unit 920. Although no alternating pressure, percussion or vibration elements are shown in the block diagram of FIG. 20, it is understood that both could be provided with the system 900 in a manner consistent with this disclosure.

In this embodiment the mattress assembly 905 has an external cover that encases the mattress 910 and bolster assemblies 912, 914. Accordingly, the external cover defines a cavity around the mattress 910. In one embodiment, the mattress 910 has a head section, a plurality of seat sections, and a plurality of lower body or foot sections. A high air loss blower 922 within the control unit 920 supplies air to the cavity at the rate of roughly 5-10 cubic feet per minute. In another embodiment, the blower 922 supplies air to the cells 120 for percussion and/or vibration treatment. Air is supplied through at least one line to the bolsters 916 by a compressor 924 located in the control unit 920. In the embodiment shown in FIG. 23, air is supplied from the bolster 916 through the valve V in the respective sub-bolster 918 and then to the cells 120 in the particular section of the mattress 910. The bolsters 916 may operate as bladders having a measurable internal volume which allows for the bolster 916 to act as a storage plenum for air supplied by the control unit 920. The sub-bolsters 918 are a generally semi-rigid structure, such as foam, with internal cavities to accommodate a plurality of pressure transducers PT and one-way valves V. When the valves are in a closed position, the cells 120 in the mattress 910 maintain a constant or static pressure whereby the patient undergoes floatation support or therapy. In another design configuration, the valves V are moved from the sub-bolsters 918 to the control unit 920 or within a lower portion of the mattress 910.

As mentioned above, the control unit 920 contains the high air loss blower 922 which provides air to the cavity within the enclosure 905, and the compressor 924 which supplies air to the bolsters 916 and mattress sections. A combination pressure/vacuum switch valve 926 is positioned between the compressor 922 and the bolsters 916, which allows for air to be drawn out of the bolsters 916 in a vacuum mode. The control unit 920 further includes a power supply, a combined controller and valve board, a muffler, and an air filter. A user control interface 928 may be mounted to the control unit 920 or remotely connected to the unit 920. A electrical connector 930 is electrically positioned between the control unit 920 and the pressure transducers PT and the valves V within the sub-bolsters 918. The control unit 920 can be secured to any portion of the bed frame or support structure, including under the mattress 910. The user control interface 928 can be operably mounted in a similar manner, including to one of the bolster assemblies 912, 914.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

While the specific embodiments have been illustrated and described, numerous modifications come to mind without significantly departing from the spirit of the invention, and the scope of protection is only limited by the scope of the accompanying Claims.

What is claimed is:

1. A therapeutic mattress system for treating a patient, the mattress system comprising: a mattress having a plurality of vertically elongated cells extending a height of at least 2.5" from a base layer, the vertically elongated cells being arranged in a row and column array, each cell having a sidewall, a patient support surface extending therefrom and a cavity defined interior of the sidewall the patient support surface and the base layer, the elongated cells being grouped into a first group of cells and a second group of cells, the cavities of the cells of the first group being fluidly interconnected to define a first group chamber, and the cavities of the cells of the second group being fluidly interconnected to define a second group chamber, the first group chamber not being fluidly interconnected with the second group chamber, the first group of cells having an inlet port and an exit port to allow air to be injected into the first group of cells at the inlet port and to allow at least a portion of the air in the first group of cells to be exhausted at the exit port, the second group of cells having an inlet port and an exit port to allow air to be injected into the second group of cells at the inlet port and to allow at least a portion of the air in the second group of cells to be exhausted at the exit port.

2. The therapeutic mattress system of claim 1, wherein the cells of the first group alternate with the cells of the second group diagonally across the mattress.

3. The therapeutic mattress system of claim 1, wherein the mattress has a plurality of adjacent edges, the cells of the first group extending in a plurality of diagonal groupings from one edge of the mattress to an adjacent edge of the mattress, and the cells of the second group extending in a plurality of diagonal groupings from one edge of the mattress to an adjacent edge of the mattress.

4. The therapeutic mattress system of claim 3, wherein the diagonal groupings of cells of the first group alternate about the mattress with the diagonal groupings of cells of the second group.

5. The therapeutic mattress system of claim 1, wherein the elongated cells have a height of at least 3.5 inches.

6. The elongated mattress system of claim 1, wherein the elongated cells have movement about six degrees of freedom, including both directions in an x-axis, both directions in a y-axis and both directions in the z-axis.

7. The elongated mattress system of claim 1, wherein the elongated cells have a generally cylindrical shape.

8. The therapeutic mattress system of claim 1, further comprising a blower connected to the entrance and exit ports of the first and second group of cells.

9. The therapeutic mattress system of claim 1, further comprising a blower that supplies air to each of the inlet ports of the chambers of the mattress, and that exhausts air from the exit ports of the mattress in an alternating manner whereby one of the first and the second cell group has a first air pressure and the other of the first and the second cell group has a second air pressure different from the first air pressure.

10. The therapeutic mattress system of claim 9, further comprising a valve connected to the exit ports of the mattress, the valve operating to exhaust air from the cell groups in an alternating manner whereby one cell group has a first air pressure and the other cell group has a second and different air pressure.

11. The therapeutic mattress system of claim 1, wherein the forces and pressures pushing back on the patient by the mattress are kept substantially equal at all points of contact on the patient.

12. The therapeutic mattress system of claim 1, further comprising a non-air mattress component adjacent the mattress component to form the overall patient surface, the non air-mattress component having a top surface at generally the same height as the patient support surface of the elongated cells.

13. The therapeutic mattress system of claim 1, wherein a non-air mattress component is provided in an upper body section of the therapeutic mattress system, and wherein the elongated cell mattress component is provided in a portion of the lower body section of the therapeutic mattress system.

14. The therapeutic mattress system of claim 1, wherein each grouping of cells having a volume of air exerts a treatment force on a patient on the mattress.

15. The therapeutic mattress system of claim 14, wherein the treatment force is one of percussion, vibration, or alternating pressure.

16. A therapeutic mattress system for treating a patient, the mattress system comprising: a mattress having plurality of vertically elongated cells extending from a base layer, the vertically elongated cells being arranged in a row and column grid arrangement, each cell having a sidewall and a patient support surface extending therefrom, and a cavity defined interior of the sidewall the patient support surface and the base layer, the elongated cells being grouped into a first group of cells and a second group of cells, wherein the cavities of the cells of the first group are fluidly interconnected to define a first group chamber, and wherein the cavities of the cells of the second group are fluidly interconnected to define a second group chamber, the first group chamber not being fluidly interconnected with the second group chamber, the first group of cells having at least one port to allow air to be injected into the first group of cells and exhausted from the first group of cells, the second group of cells having at least one port to allow air to be injected into and exhausted from the second group of cells, wherein the inlet and exit ports are distinct ports for each respective group of cells; and, a blower having a first port in fluid communication with the at least one port of the first group of cells, and a second port in fluid communication with the at least one port of the second group of cells, the blower supplying air to the respective ports of the groups of in an alternating manner to have one of the first group of cells and the second group of cells at a first pressure and the other of the first group of cells and the second group of cells at a second pressure, the second pressure being lower than the first pressure at a first period of time and the second pressure being greater than the first pressure at a second period of time.

17. The therapeutic mattress system of claim 16, wherein the cells of the first group alternate with the cells of the second group diagonally across the mattress.

18. The therapeutic mattress system of claim 16, wherein the vertically elongated cells have movement about six degrees of freedom, including both directions in an x-axis, both directions in a y-axis and both directions in the z-axis.

19. The therapeutic mattress system of claim 16, wherein the group of cells with the greater pressure still allows for at least partial immersion of the patient in that group of cells to allow for greater contact area to be achieved for dispersion of pressure on generally all of the patients body.

* * * * *